US008923709B2

(12) United States Patent
Itabashi et al.

(10) Patent No.: US 8,923,709 B2
(45) Date of Patent: Dec. 30, 2014

(54) IMAGE FORMING APPARATUS CAPABLE OF DETERMINING A CONDITION OF CARTRIDGE ASSEMBLED THEREIN

(71) Applicants: Nao Itabashi, Nagoya (JP); Naoya Kamimura, Ichinomiya (JP)

(72) Inventors: Nao Itabashi, Nagoya (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 141 days.

(21) Appl. No.: 13/628,091

(22) Filed: Sep. 27, 2012

(65) Prior Publication Data

US 2013/0084081 A1 Apr. 4, 2013

(30) Foreign Application Priority Data

Sep. 29, 2011 (JP) ..... 2011-214593

(51) Int. Cl.
*G03G 15/08* (2006.01)
*G03G 21/18* (2006.01)

(52) U.S. Cl.
CPC ..... *G03G 21/1867* (2013.01); *G03G 21/1875* (2013.01); *G03G 21/1896* (2013.01)
USPC ..... 399/12

(58) Field of Classification Search
CPC ..... G03G 15/08
USPC ..... 399/12
See application file for complete search history.

(56) References Cited

U.S. PATENT DOCUMENTS

| | | | |
|---|---|---|---|
| 5,053,816 | A | 10/1991 | Takahashi |
| 7,095,967 | B2 | 8/2006 | Karakama et al. |
| 7,512,347 | B2 | 3/2009 | Suzuki et al. |
| 7,978,997 | B2 | 7/2011 | Tokuda |
| 2002/0012542 | A1 | 1/2002 | Karakama et al. |
| 2005/0025508 | A1 | 2/2005 | Karakama et al. |

(Continued)

FOREIGN PATENT DOCUMENTS

| | | | |
|---|---|---|---|
| EP | 1016939 | A2 | 7/2000 |
| JP | 07-160173 | A | 6/1995 |

(Continued)

OTHER PUBLICATIONS

European Search Report issued in European Patent Application No. 121860142.2 mailed on Jan. 2, 2014.

(Continued)

*Primary Examiner* — Clayton E Laballe
*Assistant Examiner* — Kevin Butler
(74) *Attorney, Agent, or Firm* — Banner & Witcoff, Ltd.

(57) ABSTRACT

An image forming apparatus includes a main casing, a cartridge, and a CPU. The main casing includes a detection electrode. The cartridge which accommodates toner therein, is attachable to and detachable from the main casing, and has a cartridge electrode electrically connectable to the detection electrode, and a moving member supported to the cartridge electrode. The moving member is movable from a first position where an electrical connection between the cartridge electrode and the detection electrode is interrupted to a third position where the electrical connection is interrupted via a second position where the electrical connection is established. The CPU is configured to judge whether or not the assembled cartridge is a new cartridge. The CPU determines that the assembled cartridge is new when the electrical connection is first interrupted, and established, and then interrupted in accordance with the movement of the moving member.

14 Claims, 11 Drawing Sheets

(56) References Cited

U.S. PATENT DOCUMENTS

| | | | | |
|---|---|---|---|---|
| 2005/0276617 | A1 | 12/2005 | Matsumoto et al. | |
| 2006/0193646 | A1 | 8/2006 | Suzuki et al. | |
| 2007/0059018 | A1* | 3/2007 | Tokuda | 399/90 |
| 2012/0051762 | A1 | 3/2012 | Maruyama et al. | |
| 2013/0051816 | A1 | 2/2013 | Itabashi | |
| 2013/0177326 | A1 | 7/2013 | Hamaya | |

FOREIGN PATENT DOCUMENTS

| | | | | |
|---|---|---|---|---|
| JP | 09-171340 | A | 6/1997 | |
| JP | 09-190136 | A | 7/1997 | |
| JP | 10-003241 | A | 1/1998 | |
| JP | 11-258968 | A | 9/1999 | |
| JP | EP1016939 | * | 7/2000 | G03G 15/00 |
| JP | 3416664 | B2 | 6/2003 | |
| JP | 2006-267994 | A | 10/2006 | |
| JP | 2006-337401 | A | 12/2006 | |
| JP | 2007-079284 | A | 3/2007 | |
| JP | 3938545 | B2 | 6/2007 | |
| JP | 2009-175293 | A | 8/2009 | |
| JP | 2012-053168 | A | 3/2012 | |
| JP | 2013-073213 | A | 4/2013 | |

OTHER PUBLICATIONS

European Search Report issued in European Patent Application No. 12186014.2 mailed on Jan. 2, 2014.

Non-Final Office Action received in corresponding U.S. Appl. No. 13/720,222 mailed Apr. 11, 2013.

* cited by examiner

TOP
REAR
RIGHT
LEFT
FRONT
BOTTOM 125
37
28
38
70
33
151
55
30(16)
71
87
72
81
86
82
88
89
74A
(74)
73
75
74B
(74)
153
48
45
34R(34)
31
36
35

TOP
REAR
RIGHT
LEFT
FRONT
BOTTOM 225
35
36
31
34R(34)
45
48
253
73
72
275
274B (274)
274A (274)
89
82
88
81
86
87
71
30(16)
55
151
33
70
38
28
37

IMAGE FORMING APPARATUS CAPABLE OF DETERMINING A CONDITION OF CARTRIDGE ASSEMBLED THEREIN

CROSS REFERENCE TO RELATED APPLICATION

This application claims priority from Japanese Patent Application No. 2011-214593 filed Sep. 29, 2011. The entire content of the priority application is incorporated herein by reference.

TECHNICAL FIELD

The present invention relates to an electro-photographic type image forming apparatus, and to a cartridge to be used in the image forming apparatus.

BACKGROUND

As an electro-photographic type image forming apparatus, a printer including a photosensitive body and a developing device configured to supply toner to the photosensitive body is known.

A conventional printer is provided with a detection device for detecting information on a developing cartridge assembled therein, for example, for detecting whether or not the cartridge is a brand new cartridge.

In a laser printer proposed in Japanese patent application publication No. 2006-267994, a detection gear is rotatably provided on a developing cartridge. A contact protrusion is provided on the detection gear for contacting an actuator in a main casing of the laser printer. When the developing cartridge is assembled to the main casing, the detection gear is driven to rotate so that the contact protrusion permits the actuator to pivotally move. A photo-sensor detects this pivotal movement of the actuator, enabling the laser printer to acquire information on the developing cartridge based on the detection results.

SUMMARY

However, in the laser printer described above, the actuator contactable with the contact protrusion provided on the developing cartridge and the photo-sensor configured to detect the pivotal movement of the actuator are provided within the main casing. This results in a complex structure for determining information on the assembled developing cartridge.

In view of the foregoing, it is an object of the present invention to provide an image forming apparatus capable of determining information on a developing cartridge with a simple structure.

In order to attain the above and other objects, the present invention provides an image forming apparatus including: a main casing; a cartridge; and a judgment unit. The cartridge is configured to be attached to and detached from the main casing and to accommodate therein developing agent. The cartridge has a cartridge electrode configured to receive an electric power from the main casing. The judgment unit is provided in the main casing and configured to judge a condition of the cartridge. The main casing includes: a first main electrode configured to be electrically connected to the cartridge electrode and configured to supply an electric power to the cartridge electrode; and a second main electrode configured to be electrically connected to the cartridge electrode and configured to receive an electric power from the cartridge electrode. The cartridge includes: a moving member configured to be moved from a first position where an electrical connection is interrupted between the cartridge electrode and at least one of the first main electrode and the second main electrode to a second position where an electrical connection is established between the cartridge electrode and the first main electrode and between the cartridge electrode and the second main electrode, and then, from the second position to a third position where an electrical connection is interrupted between the cartridge electrode and at least one of the first main electrode and the second main electrode. The judgment unit makes a judgment that the condition of the cartridge is new when the electrical connection is established between the cartridge electrode and the first main electrode and between the cartridge electrode and the second main electrode after the electrical connection is interrupted between the cartridge electrode and at least one of the first main electrode and the second main electrode, and then the electrical connection is once again interrupted between the cartridge electrode and at least one of the first main electrode and the second main electrode.

BRIEF DESCRIPTION OF THE DRAWINGS

In the drawings;

FIGS. 4A through 4C are views for description of movement of the moving member in a new cartridge detecting operation; and in which FIG. 4A shows a state prior to a warm-up operation where an electrical connection between the moving member and a detection electrode is interrupted; FIG. 4B shows a state of the warm-up operation where the electrical connection between the moving member and the detection electrode is established; and FIG. 4C shows a state after the warm-up operation where the electrical connection between the moving member and the detection electrode is interrupted;

FIGS. 5A through 5D are views for description of movement of a moving member in a new cartridge detecting operation according to a second embodiment of the present invention; and in which FIG. 5A shows a state prior to a warm-up operation where an electrical connection between a detected portion and a detection electrode is interrupted; FIG. 5B shows a state of the warm-up operation where the electrical connection between the detected portion and the detection electrode is established; FIG. 5C shows a state of the warm-up operation where the electrical connection between the detected portion and the detection electrode is interrupted; and FIG. 5D shows a state after the warm-up operation where the electrical connection between the detected portion and the detection electrode is established.

FIGS. 6A through 6D are views for description of movement of a moving member in a new cartridge detecting operation according to a third embodiment of the present invention; and in which FIG. 6A shows a state prior to a warm-up operation where an electrical connection is interrupted between a detected portion and a detection electrode and between a power receiving portion and a power supply electrode; FIG. 6B shows a state of the warm-up operation where the electrical connection is established between the detected portion and the detection electrode and between the power receiving portion and the power supply electrode; FIG. 6C shows a state of the warm-up operation where the electrical connection is interrupted between the detected portion and the detection electrode and between the power receiving portion and the power supply electrode; and FIG. 6D shows a state after the warm-up operation where the electrical connection is established between the detected portion and the detection electrode and between the power receiving portion and the power supply electrode;

FIGS. 7A through 7C are views for description of movement of a moving member in a new cartridge detecting operation according to a fourth embodiment of the present invention; and in which FIG. 7A shows a state prior to a warm-up operation where an electrical connection between a detected portion and a detection electrode is interrupted; FIG. 7B shows a state of the warm-up operation where the electrical connection between the detected portion and the detection electrode is established; and FIG. 7C shows a state after the warm-up operation where the electrical connection between the detected portion and the detection electrode is interrupted;

FIGS. 8A through 8C are views for description of movement of a moving member in a new cartridge detecting operation according to a fifth embodiment of the present invention; and in which FIG. 8A shows a state prior to a warm-up operation where an electrical connection between a power receiving portion and a detection electrode is interrupted; FIG. 8B shows a state of the warm-up operation where the electrical connection between the power receiving portion and the detection electrode is established through a conducting portion of the moving member; and FIG. 8C shows a state after the warm-up operation where the electrical connection between the power receiving portion and the detection electrode is interrupted;

FIGS. 10A and 10B are views for description of movement of the moving member in a new cartridges detecting operation according to the sixth embodiment; in which FIG. 10A shows a state where the moving member and a detection electrode are spaced away from each other; and FIG. 10B shows a state where the moving member and the detection electrode contact each other; and FIGS. 11A and 11B are views for description of movement of a moving member in a new cartridge detecting operation according to a seventh embodiment; in which FIG. 11A shows a state where a detected portion and a detection electrode are spaced away from each other; and FIG. 10B shows a state where the detected portion and the detection electrode contact each other.

DETAILED DESCRIPTION

A color printer as an image forming apparatus according to a first embodiment of the present invention will be described with reference to FIGS. 1 through 4C. Throughout the specification, the terms "upward", "downward", "upper", "lower", "above", "below", "beneath", "right", "left", "front", "rear" and the like will be used assuming that the image forming apparatus is disposed in an orientation in which it is intended to be used. More specifically, in FIG. 1 a left side and a right side are a front side and a rear side, respectively.

1. Overall Structure of Color Printer

Figure 1:
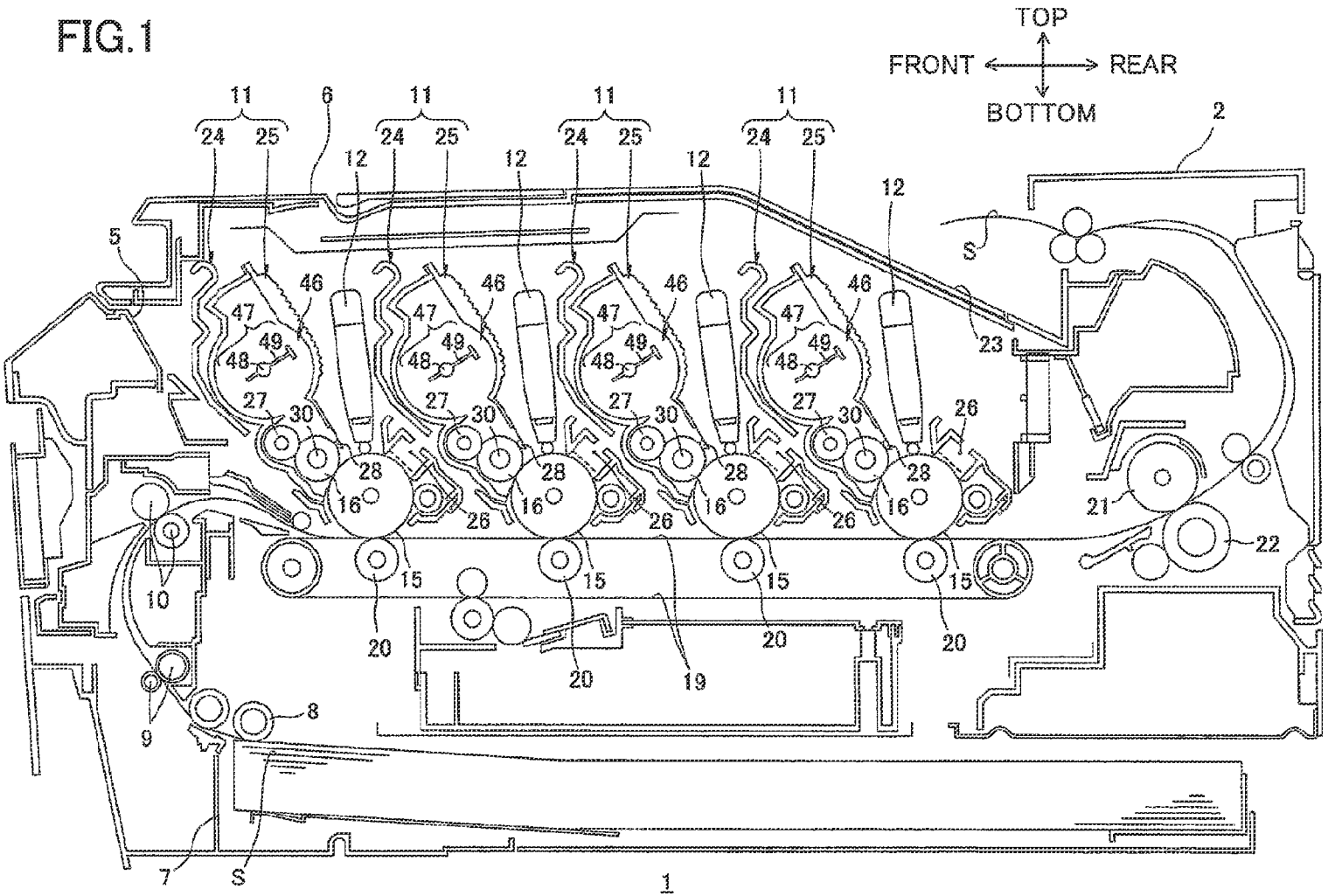
FIG. 1 is a cross-sectional view of a printer according to a first embodiment of the present invention.

Referring to FIG. 1, the printer 1 is a horizontal direct tandem type color printer. The printer 1 includes a main casing 2 having a generally box shape. The main casing 2 has an upper portion provided with a top cover 6 which can be opened or closed for opening and closing an opening 5. The top cover 6 has a rear end portion pivotally movably supported to the main casing 2. The printer 1 includes four process cartridges 11 corresponding to colors different from each other.

Each process cartridge 11 is detachable and attachable relative to the main casing 2. When mounted, the process cartridges 11 are juxtaposedly arrayed in the frontward/rearward direction at intervals within the main casing 2. Each process cartridge 11 includes a drum cartridge 24 and a developing cartridge 25 detachable from and attachable to the drum cartridge 24.

Each drum cartridge 24 has a photosensitive drum 15. The photosensitive drum 15 is cylindrical in shape and extends in a lateral direction (rightward/leftward direction), and is rotatably supported to a frame of the drum cartridge 24.

The developing cartridge 25 has a developing roller 16 which has a developing roller shaft 30 extending in the lateral direction and made from a metal. The developing roller 16 has a rear side exposed to an outside through a rear end portion of a frame of the developing cartridge 25. The developing roller 16 is positioned diagonally above and frontward of the photosensitive drum 15 and in contact therewith.

The developing cartridge 25 is provided with a supply roller 27, a layer thickness regulation blade 28, a toner chamber 46, and an agitator 47. The supply roller 27 is adapted to supply toner to the developing roller 16. The layer thickness regulation blade 28 is adapted to regulate a thickness of a toner layer supplied to the developing roller 16. The toner chamber 46 is positioned above the supply roller 27 and the layer thickness regulation blade 28, and the agitator 47 is provided in the toner chamber 46 for agitating the toner. The agitator 47 includes an agitation shaft 48 extending in the lateral direction and agitation blades 49 extending radially outwardly from the agitation shaft 48.

Toner accommodated in the toner chamber 46 is subjected tribo-electric charging to have a positive polarity between the supply roller 27 and the developing roller 16. The toner is carried on an outer peripheral surface of the developing roller 16 in a form of a thin toner layer having a uniform thickness by the layer thickness regulation blade 28.

A scorotron charger 26 and an LED unit 12 are provided in confrontation with each photosensitive drum 15. After an outer peripheral surface of the photosensitive drum 15 is uniformly charged by the scorotron charger 26, the surface is exposed to light by the LED unit 12 based on a predetermined image data to form an electrostatic latent image on the surface. Then, a visible toner image (developing agent image) corresponding to the electrostatic latent image is formed on the outer peripheral surface of the photosensitive drum 15 by supplying toner carried on the developing roller 16 to the corresponding photosensitive drum 15.

A sheet cassette 7 is provided at a bottom portion of the main casing 2 for accommodating sheets S therein in a stacked state. Each sheet S accommodated in the sheet cassette 7 is passed through a U-shaped passage and is conveyed to a position between the photosensitive drum 15 and a conveyor belt 19 positioned below the photosensitive drum 15 at a prescribed timing by a pickup roller 8, a sheet supply roller 9 and a pair of registration rollers 10. Then, each sheet S is conveyed rearward by the conveyer belt 19 at a position between each photosensitive drum 15 and each transfer roller 20 corresponding to the photosensitive drum 15. The toner image formed on the outer peripheral surface of each photosensitive drum 15 is sequentially transferred and superimposed onto the sheet S, thereby providing a color image on the sheet S.

The sheet S on which the color image has been formed is then conveyed to a fixing unit provided rearward of the conveyer belt 19. The fixing unit includes a heat roller 21 and a pressure roller 22. The color image is thermally fixed to the sheet S when the sheet S passes through the heat roller 21 and the pressure roller 22. The sheet S carrying the color image is then conveyed through an U-shaped passage frontward and upward, and is discharged onto a discharge tray 23 provided at the top cover 6.

2. Details of Developing Cartridge

Figure 2:
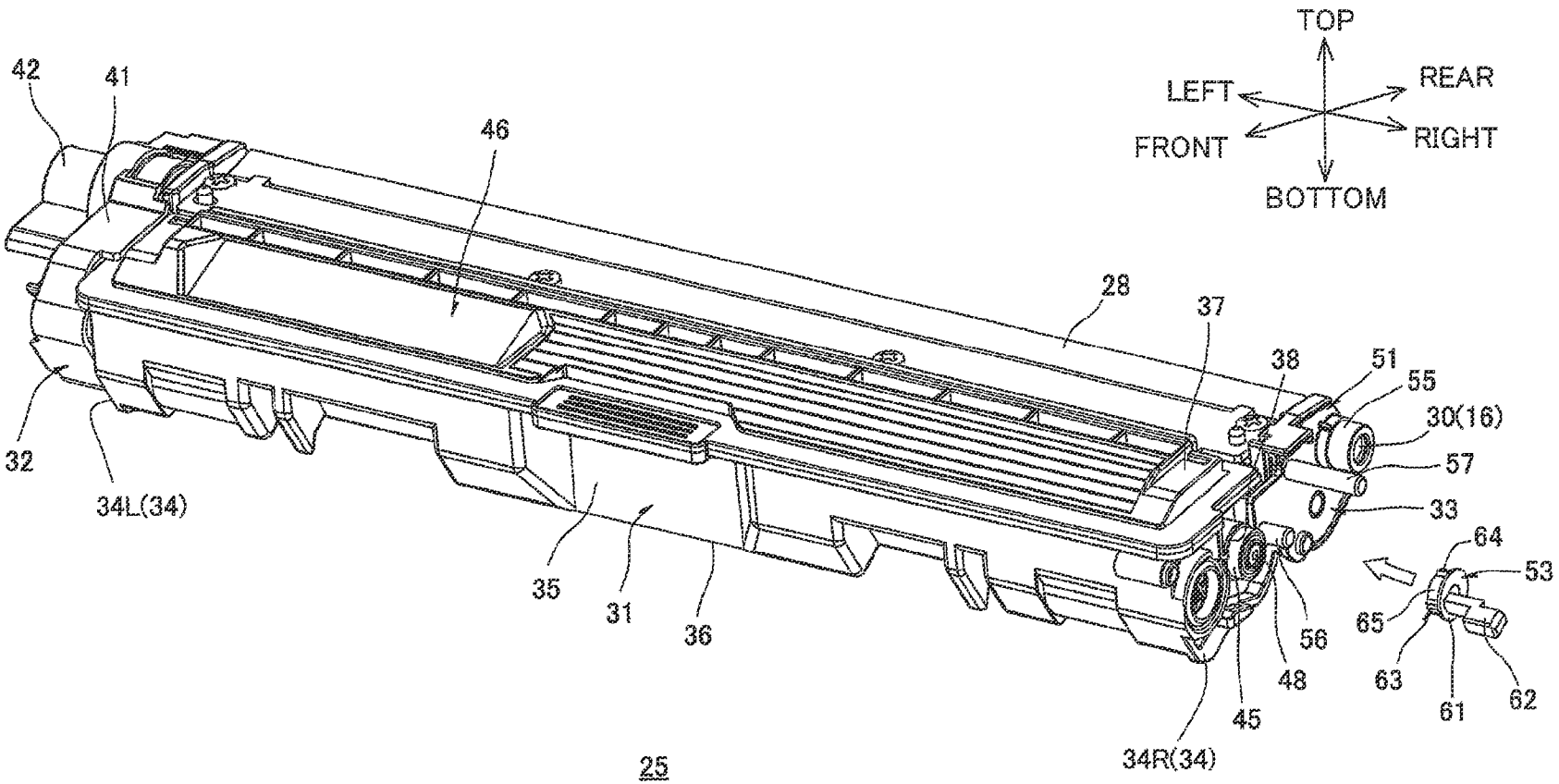
FIG. 2 is a perspective view of a developing cartridge accommodated in the printer shown in FIG. 1 as viewed from a diagonally front right side.

As shown in FIG. 2, the developing cartridge 25 includes a cartridge frame 31, a drive unit 32 positioned at a left side of the cartridge frame 31, and a power supply unit 33 positioned at a right side of the cartridge frame 31.

Throughout the description of the developing cartridge 25, regarding "direction", a side at which the developing roller 16 is positioned will be referred to as a "rear side" of the developing cartridge 25, and a side at which the thickness regulation blade 28 is positioned will be referred to as an "upper side" of the developing cartridge 25. That is, a "frontward/rearward direction" with respect to the developing cartridge 25 is different from the "frontward/rearward direction" with respect to the printer 1. More specifically, the developing cartridge 25 is assembled to the drum cartridge 24 and to the printer 1 such that the rear side and the front side of the developing cartridge 25 will correspond to a "lower rear side" and an "upper front side" of the printer 1.

(1) Cartridge Frame

The cartridge frame 31 extends in the lateral direction (confronting direction) and is generally box shaped. The cartridge frame 31 includes a pair of side walls 34, a front wall 35, a lower wall 36 and an upper wall 37. The pair of side walls 34 includes a left side wall 34L and a right side wall 34R.

Each side wall 34 extends in the frontward/rearward direction and in the vertical direction, and is generally rectangular shaped in a side view. The pair of side wails 34 is spaced away from each other in the lateral direction, and each side wall 34 is formed with an agitator shaft exposure hole 38 that exposes the agitation shaft 48 to the outside.

The agitator shaft exposure hole 38 is positioned at a generally center portion of the side wall 34 in the frontward/rearward direction and is generally circular shaped in a side view. The agitator shall exposure hole 38 is penetrated through a thickness of the side wall 34 and has a diameter greater than an outer diameter of each lateral end portion of the agitation shaft 48. Each lateral end portion of the agitation shaft 48 extends through the agitator shaft exposure hole 38 and protrudes laterally outward from the side wall 34. An agitator gear 45 is fixedly (non-rotatably) coupled to each lateral end portion of the agitator shaft 48.

The front wall 35 extends in the lateral direction and is spanned between front end portions of the side walls 34. The lower wall 36 extends in the lateral direction and is spanned between lower end portions of the side walls 34 such that the lower wall 36 is connected to a lower end portion of the front wall 35. The upper wall 37 extends in the lateral direction and is spanned between upper end portions of the side walls 34 such that the upper wall 37 is connected to an upper end portion of the front wall 35. The upper wall 37 has a rear end portion at which the layer thickness regulation blade 28 is positioned such that the layer thickness regulation blade 28 is in contact with the developing roller 16 from above.

(2) Drive Unit

As shown in FIG. 2, the drive unit 32 includes a drive side cover 41 which extends in the lateral direction with its leftmost end being closed. The drive side cover 41 is hollow prismatic body shaped, and covers a left end portion of the developing cartridge 25. The drive side cover 41 is provided with a collar portion 42. The collar portion 42 is positioned at a generally center portion of the drive side cover 41 in the frontward/rearward direction, and protrudes leftward therefrom. The collar portion 42 is generally hollow cylindrical shaped with its right end portion being in communication with an internal space of the drive side cover 41.

A generally cylindrical developing coupling (not shown) extending in the lateral direction is positioned within and supported to the collar portion 42 such that the developing coupling is rotatable relative to the collar portion 42. The developing coupling has a left end portion exposed to the outside from a left end portion of the collar portion 42. The left end portion of the developing coupling is fitted with a main coupling (not shown) provided to the main casing 2 such that relative rotation therebetween is prevented. A driving force from the main casing 2 is transmitted to the developing coupling through the main coupling. Further, the driving force is transmitted, through a gear train (not shown), to the developing roller shaft 30 of the developing roller 16, a shaft of the supply roller 27, and the agitator shaft 48.

(3) Power Supply Unit

Figure 3A:
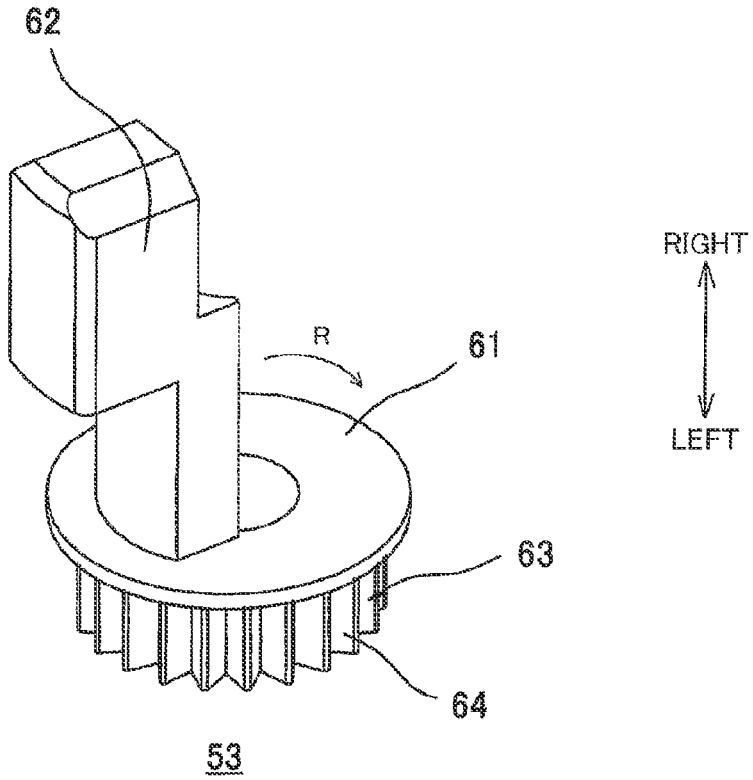
FIG. 3A is a perspective view of a moving member which is a component of the developing cartridge of FIG. 2 as viewed from a right side.
Figure 3B:
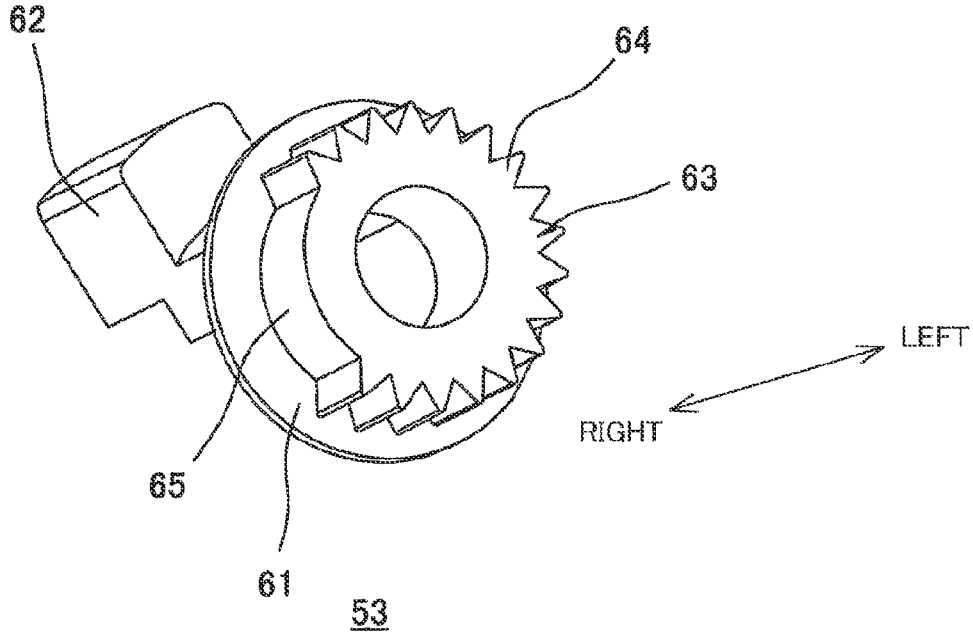
FIG. 3B is a perspective view of the moving member as viewed from a left side.

As shown in FIGS. 2, 3A and 3B, the power supply unit 33 includes a cartridge electrode 51 and a moving member 53.

(3-1) Cartridge Electrode

The cartridge electrode 51 is assembled to a right side of the right side wall 34R at the rear end portion of the developing cartridge 25. The cartridge electrode 51 is made from an electrically conductive resin, and is generally rectangular plate shaped in a side view. The cartridge electrode 51 integrally includes a developing roller shaft support portion 55, an electrode support boss 56, and a power receiving portion 57.

The developing roller shaft support portion 55 is positioned at a rear end portion of the cartridge electrode 51 and is generally hollow cylindrical shaped extending rightward from a right side surface of the cartridge electrode 51. The developing roller shaft support portion 55 has an inner diameter approximately equal to or greater than an outer diameter of a right end portion of the developing roller shaft 30. Further, the cartridge electrode 51 is formed with an opening (not shown) coaxial with the developing roller shaft support portion 55 and having a diameter equal to the inner diameter of the developing roller shaft support portion 55. The right end portion of the developing roller shall 30 extends through and is rotatably supported to the developing roller shaft support portion 55. That is, the cartridge electrode 51 and the developing roller shaft 30 are electrically connected to each other at the developing roller shaft support portion 55.

The electrode support boss 56 is positioned at a front end portion of the cartridge electrode 51. The electrode support boss 56 is generally cylindrical shaped, protruding rightward from the right side surface of the cartridge electrode 51.

The power receiving portion 57 is positioned diagonally above and rearward of and in confrontation with the electrode support boss 56 with a gap formed therebetween. The power receiving portion 57 protrudes rightward from the right side surface of the cartridge electrode 51, and is generally cylindrical shaped.

(3-2) Moving Member

Figure 4A:
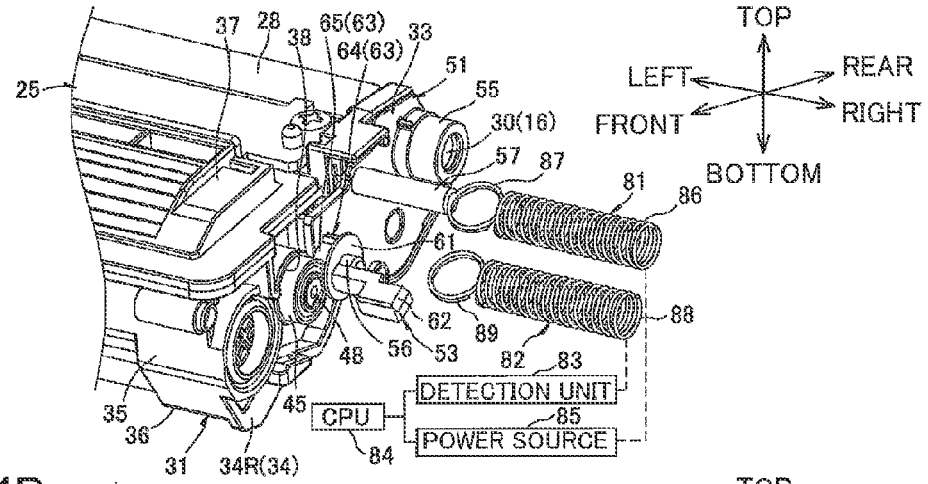
Figure 4B:
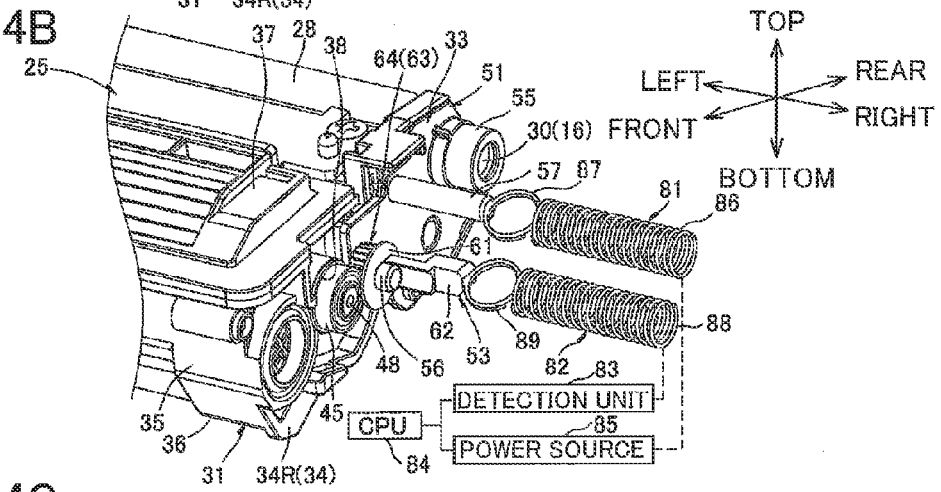
Figure 4C:
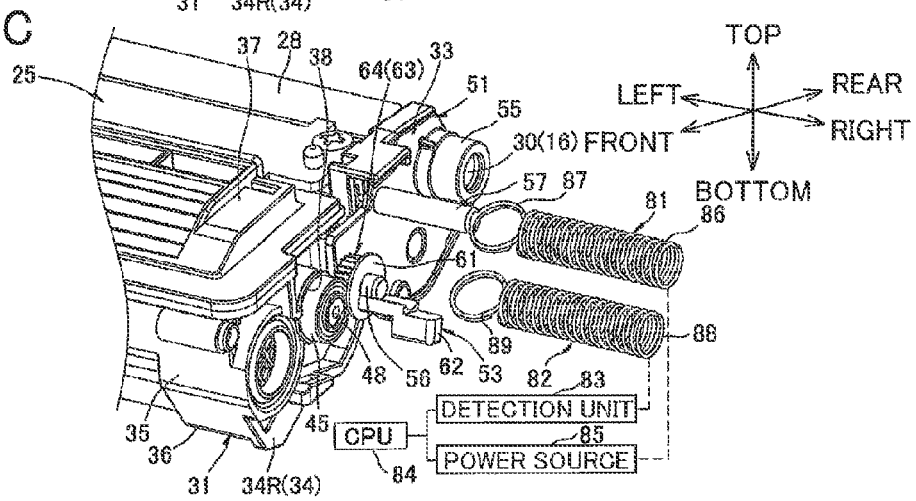

As shown in FIGS. 4A through 4C, the moving member 53 is positioned at the front end portion of the cartridge electrode 51. The moving member 53 is made from an electrically conductive material. As shown in FIGS. 3A and 3B, the moving member 53 integrally includes a base portion 61, a detected portion 62, and a chipped gear 63 (gear teeth is partly lacking).

The base portion 61 has a thickness in the lateral direction and is generally circular disc shaped whose center portion is formed with a through-hole.

The detected portion 62 is positioned radially offset from a center axis of the base portion 61. The detected portion 62 is rectangular columnar shaped and protrudes rightward from a right side surface of the base portion 61 while bending into a generally S-shape. More specifically, the detected portion 62 begins by extending rightward from the right side surface of the base portion 61, then bends at a right end portion thereof and extends outward in a radial direction of the base portion 61, and finally bends at an outer end portion and extends again rightward. A combination of the detected portion 62 and the base portion 61 constitutes a conducting portion.

The chipped gear 63 is generally cylindrical shaped extending leftward from a left side surface of the base portion 61. The chipped gear 63 is concentric with the base portion 61. Gear teeth are provided such that an array of the gear teeth along the circumferential direction of the base portion 61 has a center angle of 270 degrees. Incidentally, in the chipped gear 63, a portion where teeth are provided will be referred to as a toothed portion 64, and a portion where teeth are not provided will be referred to as a toothless portion 65.

The moving member 53 is supported to the electrode support boss 56 of the cartridge electrode 51 and is rotatable about the axis of the base portion 61 in a clockwise direction in a right side view, indicated as a rotation direction R in FIG. 3A.

In a state where the developing cartridge 25 is a new (unused) cartridge, the chipped gear 63 of the moving member 53 is in meshing engagement with the agitator gear 45 from rear at a downstream end portion of the toothed portion 64 in the clockwise direction in a right side view.

In this case, the detected portion 62 is positioned at a front end portion of the moving member 53.

3. Main Casing

As shown in FIGS. 4A through 4C, a power supply electrode 81 and a detection electrode 82 are provided within the main casing 2 for each of the process cartridges 11. Each of the power supply electrode 81 and the detection electrode 82 are connectable to the cartridge electrode 51.

The power supply electrode 81 is positioned adjacent to the right side of the corresponding process cartridge 11 when the process cartridge 11 is mounted in the main casing 2. The power supply electrode 81 integrally includes a body portion 86, and a contact portion 87.

The body portion 86 is formed of a metal or other material having electrically conductive and elastic properties. The body portion 86 has a helical shape and extends in the lateral direction.

The contact portion 87 is connected to a left end portion of the body portion 86. The contact portion 87 has a generally annular shape, with its center axis orthogonal to a center axis of the body portion 86.

The detection electrode 82 is positioned adjacent to the right side of the corresponding process cartridge 11 when the process cartridge 11 is mounted in the main casing 2 and spaced away from the power supply electrode 81 at a diagonally lower front side thereof. The detection electrode 82 has a shape substantially the same as that of the power supply electrode 81. More specifically, the detection electrode 82 integrally includes a body portion 88 and a contact portion 89.

As with the body portion 86 of the power supply electrode 81, the body portion 88 is formed of a metal or other material having electrically conductive and elastic properties. The body portion 88 has a helical shape and extends in the lateral direction.

The contact portion 89 is connected to a left end portion of the body portion 88. As with the contact portion 87 of the power supply electrode 81, the contact portion 89 has a generally annular shape, with its center axis orthogonal to a center axis of the body portion 88.

In addition to the above components, a power source 85, a bias detection unit 83, and a CPU 84 are provided within the main casing 2.

The power source 85 is electrically connected to the power supply electrode 81 and adapted to supply a developing bias to the power supply electrode 81.

The bias detection unit 83 is electrically connected to the detection electrode 82. The bias detection unit 83 is adapted to detect a developing bias supplied from the power source 85 to the detection electrode 82 sequentially through the power supply electrode 81, the power receiving portion 57 of the cartridge electrode 51, the electrode support boss 56 of the cartridge electrode 51, and the moving member 53.

The CPU 84 is electrically connected to both the power source 85 and the bias detection unit 83. The CPU 84 is adapted to determine a condition of the developing cartridge 25 based on detection results of the bias detection unit 83 detecting whether a developing bias is being supplied to the detection electrode 82.

4. Operation for Detecting New Developing Cartridge

An operation for detecting a new developing cartridge 25 will be described while referring to FIGS. 4A through 4C.

When the process cartridge 11 (developing cartridge 25) is not assembled to the main casing 2, a developing bias is not applied to the detection electrode 82. Therefore, the bias detection unit 83 does not detect a developing bias. Then, if this state continues for a predetermined time period (if a developing bias is not applied to the detection electrode 82 for a predetermined time period), the CPU 84 determines that the developing cartridge 25 is not assembled to the main casing 2.

When the top cover 6 of the main casing 2 is opened to insert, from diagonally above and frontward into the main casing 2, the process cartridge 11 to which a new (unused) developing cartridge 25 is assembled, the power receiving portion 57 of the developing cartridge 25 is brought into contact with the contact portion 87 of the power supply electrode 81 from a left side thereof.

As a result, the developing bias supplied from the power source 85 to the power supply electrode 81 is conducted to the power receiving portion 57 of the developing cartridge 25. The developing bias supplied to the power receiving portion 57 is then applied to the developing roller shaft 30 through the cartridge electrode 51. At this time, the detected portion 62 of the moving member 53 is spaced away from the detection electrode 82 at a front side thereof, so that no electrical connection is established between the detected portion 62 and the detection electrode 82. That is, the moving member 53 is positioned at a first position for interrupting an electrical connection between the detection electrode 82 and the cartridge electrode 51.

Thus, the developing bias is not applied to the detection electrode 82 and, hence, the bias detection unit 83 does not detect the developing bias. Accordingly, the CPU 84 determines that the developing bias is not being supplied to the detection electrode 82.

After assembly of the developing cartridge 25 into the main casing 2, the main coupling (not shown) in the main casing 2 is fitted with the developing coupling (not shown) of the drive unit 32, preventing relative rotation therebetween. Thus, a driving force from the main casing 2 is transmitted to the developing coupling (not shown) through the main coupling (not shown) for starting a warm-up operation. Then, a driving force from the developing coupling (not shown) is transmitted to the agitator shaft 48 through the gear train (not shown) to rotate the agitator 47.

As a result of rotation of the agitator 47, a driving force from the agitator shaft 48 is transmitted to the toothed portion 64 of the chipped gear 63 of the moving member 53 through the agitator gear 45, so that the moving member 53 is rotated in the clockwise direction in a right side view.

As the moving member 53 rotates, the detected portion 62 of the moving member 53 is brought into contact with the contact portion 89 of the detection electrode 82 from above and forms an electrical connection with the detection electrode 82, as shown in FIG. 4B. That is, the moving member 53 is positioned at a second position for electrically connecting the detection electrode 82 to the cartridge electrode 51.

As a result, the developing bias supplied from the power supply electrode 81 to the power receiving portion 57 is sequentially conducted to the detection electrode 82 through the electrode support boss 56 and the detected portion 62 of the moving member 53. Accordingly, the bias detection unit 83 detects the developing bias, and the CPU 84 determines that the developing bias is being supplied to the detection electrode 82.

As a result of further rotation of the moving member 53 in the clockwise direction in a right side view, the detected portion 62 of the moving member 53 is spaced away from the contact portion 89 of the detection electrode 82 at a lower side thereof. Consequently, the electrical connection between the moving member 53 and the detection electrode 82 is interrupted. That is, the moving member 53 is positioned at a third position in which an electrical connection is not established between the detection electrode 82 and the cartridge electrode 51.

As a result, the developing bias is no longer applied to the detection electrode 82, and the bias detection unit 83 no longer detects the developing bias. Accordingly, the CPU 84 determines that the developing bias is not being supplied to the detection electrode 82.

As shown in FIG. 4C, in accordance with further rotation of the moving member 53 in the clockwise direction in a right side view, the toothless portion 65 of the chipped gear 63 of the moving member 53 is brought into confrontation with the agitator gear 45, releasing meshing engagement between the toothed portion 64 of the chipped gear 63 and the agitator gear 45. Thus, rotation of the moving member 53 is stopped to terminate the warm-up operation.

The CPU 84 determines that the developing cartridge 25 is a new (unused) cartridge based on the determination that the developing bias is first not supplied to the detection electrode 82, then supplied to the detection electrode 82, and then not supplied to the detection electrode 82 in sequence after starting the warm-up operation.

After the determination, the CPU 84 counts printing times, and notifies and displays on an operation panel (not shown) an exchanging timing of the developing cartridge 25 when the counted printing times approaches a predetermined printing times (for example, 6000 sheets printing).

On the other hand, there is a case where after the new developing cartridge 25 is assembled, the developing cartridge 25 is again assembled to the main casing 2 after the cartridge 25 is detached from the main casing 2, for example, for removing a jammed sheet S. In such a case, rotation of the moving member 53 is stopped while the toothless portion 65 of the chipped gear 63 confronts the agitator gear 45.

Therefore, in the re-assembly, rotation of the moving member 53 is not started even after starting the warm-up operation, and as a result, the new cartridge detection will not be carried out. In the latter case, because the cartridge electrode 52 stays at the third position, the CPU 84 determines that the developing bias is not being supplied to the detection electrode 82.

Accordingly, the CPU 84 determines that the developing cartridge 25 has been assembled into the main casing 2. Further, the CPU 84 determines that the re-assembled cartridge 25 is an old (used) cartridge 25. Then, the CPU 84 continues comparison between the predetermined printing times and the accumulated total number of printing times from the timing at which the CPU 84 determines that the assembled developing cartridge 25 is a new cartridge.

5. Operations and Effects (1) The printer 1 according to the first embodiment can determine using a simple structure whether the developing cartridge 25 is a new or a used cartridge, without employing an actuator, a photo-sensor, or the like. As shown in FIGS. 4A through 4C, the printer 1 employs the bias detection unit 83 to detect whether the electrical connection between the detection electrode 82 and the moving member 53 is established or interrupted.

In addition, the detection electrode 82 and the detected portion 62 are not in contact with each other when the warm-up operation is terminated. This configuration prevents the developing bias from flowing through the detection electrode 82 to other components in the main casing 2.

(2) Further, as shown in FIGS. 4A through 4C, the printer 1 according to the first embodiment utilizes a simple structure to temporarily change the electrical connection between the detection electrode 82 and the electrode support boss 56 of the cartridge electrode 51 from a disconnected state to a connected state and then from the connected state to the disconnected state while the moving member 53 moves from the first position to the second position and then from the second position to the third position.

(3) Further, as shown in FIG. 3B, the moving member 53 of the printer 1 according to the first embodiment includes the chipped gear 63 provided with the toothed portion 64 and the toothless portion 65. Hence, the moving member 53 can be reliably moved by a predetermined moving amount.

(4) Further, with the printer 1 according to the first embodiment, the moving member 53 is rotatable so as to be moved from the first position to the second position and then from the second position to the third position, as illustrated in FIGS. 4A through 4C. Hence, with a simple construction, it is possible to move the moving member 53 reliably from the first position to the second position and then from the second position to the third position.

(5) Further, as illustrated in FIGS. 4A through 4C, the printer 1 according to the first embodiment uses the developing bias that the power source 85 in the main casing 2 applies to the developing roller 16 in order to detect information on the developing cartridge 25.

6. Second Embodiment

A developing cartridge 125 according to a second embodiment of the present invention will next be described with reference to FIGS. 5A through 5D wherein like parts and components are designated by the same reference numerals as those shown in the first embodiment (FIGS. 1 through 4C) to avoid duplicating description.

(1) Structure of Second Embodiment

According to the first embodiment, the power supply electrode 81 is contacted with the power receiving portion 57 of the cartridge electrode 51, and the moving member 53 formed of an electrically conductive material and supported to the electrode support boss 56 of the cartridge electrode 51 is moved to contact the detection electrode 82.

In contrast, according to the second embodiment, as shown FIGS. 5A through 5D, a cartridge electrode 151 includes a power receiving portion 71 contactable with the power supply electrode 81, and a detected portion 72 contactable with the detection electrode 82. A moving member 153 is formed of an insulating material. The moving member 153 is positioned between the detection electrode 82 and the detected portion 72.

The power receiving portion 71 is positioned at an upper end portion of and at a generally center portion of the cartridge electrode 151 in the frontward/rearward direction. The power receiving portion 71 is generally cylindrical shaped extending rightward from a right side surface of the cartridge electrode 151. The power receiving portion 71 has a right end portion contactable with the contact portion 87 of the power supply electrode 81.

The detected portion 72 is positioned in confrontation with and spaced away from the power receiving portion 71 at a diagonally lower front side thereof. The detected portion 72 is generally cylindrical shaped extending rightward from the right side surface of the cartridge electrode 151. The detected portion 72 is connected to the power receiving portion 71 by a rib 70. The detected portion 72 has a right end portion contactable with the contact portion 89 of the detection electrode 82.

In place of the detected portion 62 of the moving member 53 according to the first embodiment, the moving member 153 according to the second embodiment integrally includes an insulating portion 73 formed of an insulating material.

The insulating portion 73 is positioned radially offset from the center axis of the base portion 61. The insulating portion 73 is generally partial cylindrical shaped extending rightward from the right side surface of the base portion 61. The insulating portion 73 is provided with an insulating plate 75 at a right end portion of the insulating portion 73. The insulating plate 75 is generally sector shaped with a center angle of approximately 90 degrees.

The insulating plate 75 is formed with two detection windows 74 spaced away from each other along a circumferential direction of the insulating plate 75 following a curvature of the sector shape. Each of the detection windows 74 is penetrated through a thickness of the insulating plate 75. The detection window 74 is generally circular shaped in a side view and has a diameter greater than an outer diameter of the detected portion 72.

One of the detection windows 74 positioned at a downstream side in a clockwise direction a right side view will be referred to as a first detection window 71A, and a remaining one of the two detection windows 74 positioned at an upstream side in the clockwise direction in a right side view will be referred to as a second detection window 74B.

In a state where the developing cartridge 125 is a new (unused) cartridge, the insulating plate 75 is positioned at an upper end portion of the moving member 153 with its center angle at a lower end portion of the insulating plate 75.

At this time, a downstream end portion of the insulating plate 75 in the clockwise direction in a right side view is positioned in confrontation with the right end portion of the detected portion 72 at a right side thereof.

(2) Operation of Second Embodiment

A developing bias is not applied to the detection electrode 82 when the process cartridge 11 (developing cartridge 125) is not assembled to the main easing 2. Therefore, the bias detection unit 83 does not detect a developing bias.

Then, if this state continues for a predetermined time period (if a developing bias is not applied to the detection electrode 82 for a predetermined time period), the CPU 84 determines that the developing cartridge 125 is not assembled to the main casing 2.

Figures 5A, 5B, 5C, 5D:
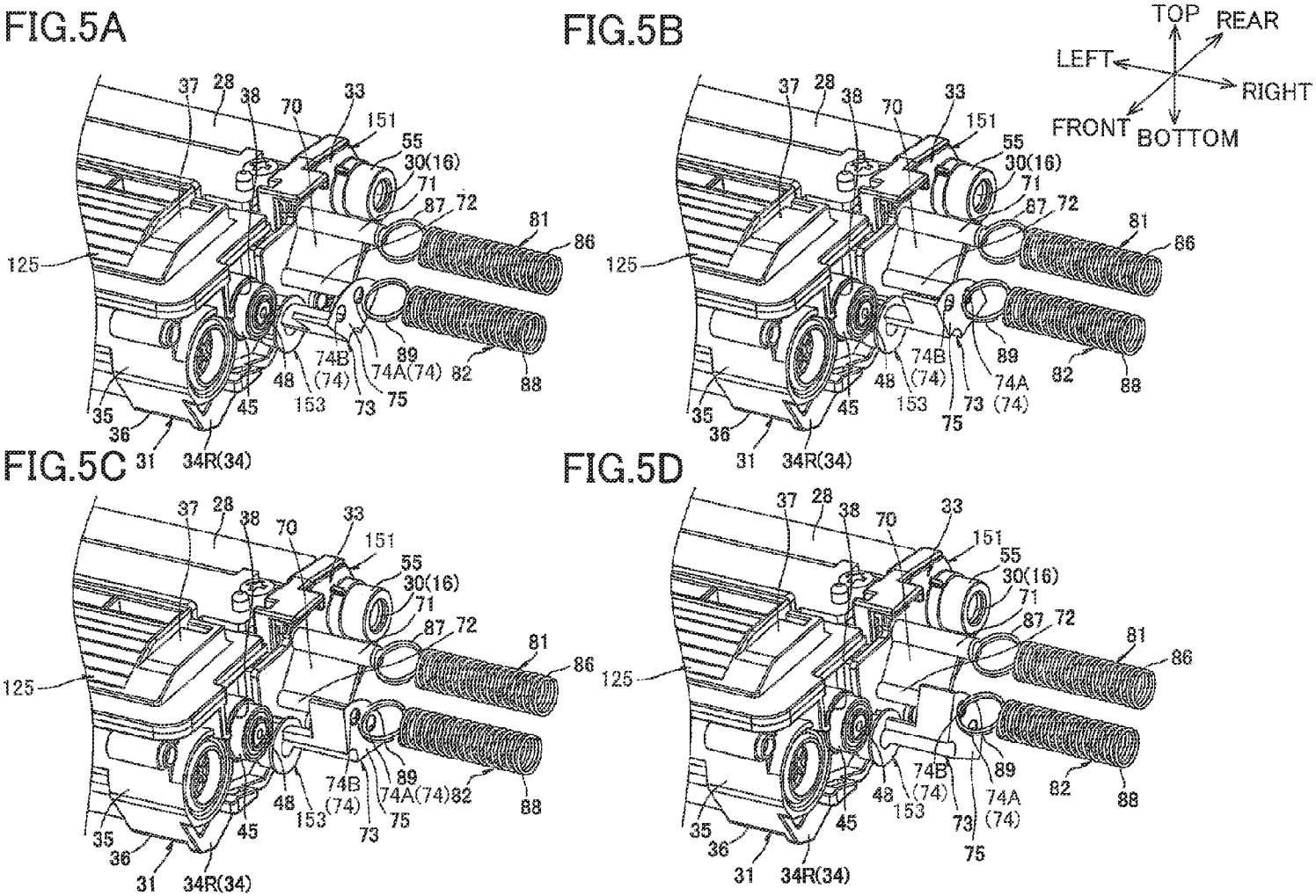

When the process cartridge 11 to which a new (unused) developing cartridge 125 is assembled is inserted into the main casing 2 from diagonally above and frontward, the power receiving portion 71 of the developing cartridge 125 is brought into contact with the contact portion 87 of the power supply electrode 81 from a left side thereof, as shown in FIG. 5A. At this time, the detected portion 72 confronts the contact portion 89 of the detection electrode 82 with the insulating plate 75 interposed therebetween.

In this state, the developing bias supplied from the power source 85 to the power supply electrode 81 is conducted to the power receiving portion 71, and the developing bias supplied to the power receiving portion 71 is applied to the developing-roller shaft 30 through the cartridge electrode 151.

Further, the insulating plate 75 insulates the detected portion 72 from the detection electrode 82, interrupting an electrical connection between the detected portion 72 and the detection electrode 82. That is, the moving member 153 is positioned at a first position for interrupting an electrical connection between the detection electrode 82 and the cartridge electrode 151.

Thus, the developing bias is not applied to the detection electrode 82, and, hence, the bias detection unit 83 does not detect the developing bias. Accordingly, the CPU 84 determines that the developing bias is not being supplied to the detection electrode 82.

Upon starting the warm-up operation, the moving member 153 is rotated in the clockwise direction in a right side view.

As the moving member 153 rotates, the first detection window 74A positioned at the downstream side of the insulating plate 75 in the clockwise direction in a right side view is positioned between the detected portion 72 and the detection electrode 82, as shown in FIG. 5B. At this time, an electrical connection between the detected portion 72 and the detection electrode 82 is established through the first detection window 74A of the insulating plate 75. That is, the moving member 153 is positioned at a second position for allowing an electrical connection between the detection electrode 82 and cartridge electrode 151.

As a result, the developing bias supplied from the power supply electrode 81 to the power receiving portion 71 is conducted to the detection electrode 82 through the rib 70 and the detected portion 72. Accordingly, the bias detection unit 83 detects the developing bias, and the CPU 84 determines that the developing bias is being supplied to the detection electrode 82.

As a result of further rotation of the moving member 153 in the clockwise direction in a right side view, a portion of the insulating plate 75 between the two detection windows 74 (74A, 74B) is interposed between the detected portion 72 and the detection electrode 82, as shown in FIG. 5C.

Therefore, the insulating plate 75 insulates the detected portion 72 from the detection electrode 82, interrupting the electrical connection between the detected portion 72 and the detection electrode 82. That is, the moving member 153 is positioned at a third position for interrupting an electrical connection between the detection electrode 82 and the cartridge electrode 151.

Thus, the developing bias is no longer applied to the detection electrode 82, and, hence, the bias detection unit 83 no longer detects the developing bias. Accordingly, the CPU 84 determines that the developing bias is not being supplied to the detection electrode 82.

The CPU 84 determines that the developing cartridge 125 is a new (unused) cartridge based on the determination that the developing bias is first not supplied to the detection electrode 82, then supplied to the detection electrode 82, and then not supplied to the detection electrode 82 in sequence after starting the warm-up operation.

In accordance with further rotation of the moving member 153 in the clockwise direction in a right side view, as shown in FIG. 5D, the toothless portion 65 of the moving member 153 is brought into confrontation with the agitator gear 45, releasing meshing engagement between the toothed portion 64 of the moving member 153 and the agitator gear 45. Thus, rotation of the moving member 153 is stopped to terminate the warm-up operation.

At the same time, the second detection window 74B positioned at the upstream side of the insulating plate 75 in the clockwise direction in a right side view is positioned between the detected portion 72 and the detection electrode 82. Hence, an electrical connection between the detected portion 72 and the detection electrode 82 is established through the second detection window 74B of the insulating plate 75.

As a result, the developing bias supplied from the power supply electrode 81 to the power receiving portion 71 is conducted to the detection electrode 82 through the rib 70 and the detected portion 72. Accordingly, the bias detection unit 83 detects the developing bias, and the CPU 84 determines that the developing bias is being supplied to the detection electrode 82.

Then, if this state continues for a predetermined time period (if a developing bias is continually supplied to the detection electrode 82 for a predetermined time period), the CPU 84 determines that the developing cartridge 125 is assembled to the main casing 2.

(3) Operations and Effects of Second Embodiment

According to the second embodiment shown in FIGS. 5A through 5C, the insulating plate 75 of the insulating portion 73 is positioned between the detected portion 72 and detection electrode 82 when the moving member 53 is positioned at both the first position (FIG. 5A) and the third position (FIG. 5C). On the other hand, the detected portion 72 and the detection electrode 82 contact each other through one of the detection windows 74 formed in the insulating plate 75 when the moving member 53 is positioned at the second position (FIG. 5B).

Hence, with a simple structure, the electrical connection between the detection electrode 82 and the cartridge electrode 151 can be changed from a disconnected state to a connected state and then from the connected state to the disconnected state while the moving member 153 moves from the first position to the second position and then from the second position to the third position.

Further, according to the second embodiment, with a simple structure, existence or non-existence of the developing cartridge 125 in the main casing 2 can be detected by detecting the establishment and the interruption of the electrical connection between the detection electrode 82 and the cartridge electrode 151.

7. Third Embodiment

A developing cartridge 225 according to a third embodiment of the present invention will next be described with reference to FIGS. 6A through 6D wherein like parts and components are designated by the same reference numerals as those shown in the second embodiment (FIGS. 5A through 5D) to avoid duplicating description.

(1) Structure of Third Embodiment

According to the second embodiment, the insulating plate 75 is generally sector shaped and has a size sufficient to confront the right end portion of the detected portion 72 from a right side thereof.

In contrast, according to the third embodiment, as shown in FIGS. 6A through 6D, an insulating plate 275 of a moving member 253 is generally sector shaped and has a size sufficient to confront both the detected portion 72 and the power receiving portion 71.

The insulating plate 275 is formed with two detection windows 274. Each of the detection windows 274 is an elongate hole extending in a radial direction of the insulating plate 275. The detection window 274 has a length sufficient to expose both the detected portion 72 and the power receiving portion 71 to the outside.

One of the two detection windows 274 positioned at a downstream side in a clockwise direction in a right side view will be referred to as a first detection window 274A, and a remaining one of the two detection windows 274 positioned at an upstream side in the clockwise direction in a right side view will be referred to as a second detection window 274B.

(2) Operation of Third Embodiment

A developing bias is not applied to the detection electrode 82 when the process cartridge 11 (developing cartridge 225) is not assembled to the main casing 2. Therefore, the bias detection unit 83 does not detect a developing bias.

Then, if this state continues for a predetermined time period (if a developing bias is not applied to the detection electrode 82 for a predetermined time period), the CPU 84 determines that the developing cartridge 225 is not assembled to the main casing 2.

Figures 6A, 6B, 6C, 6D:
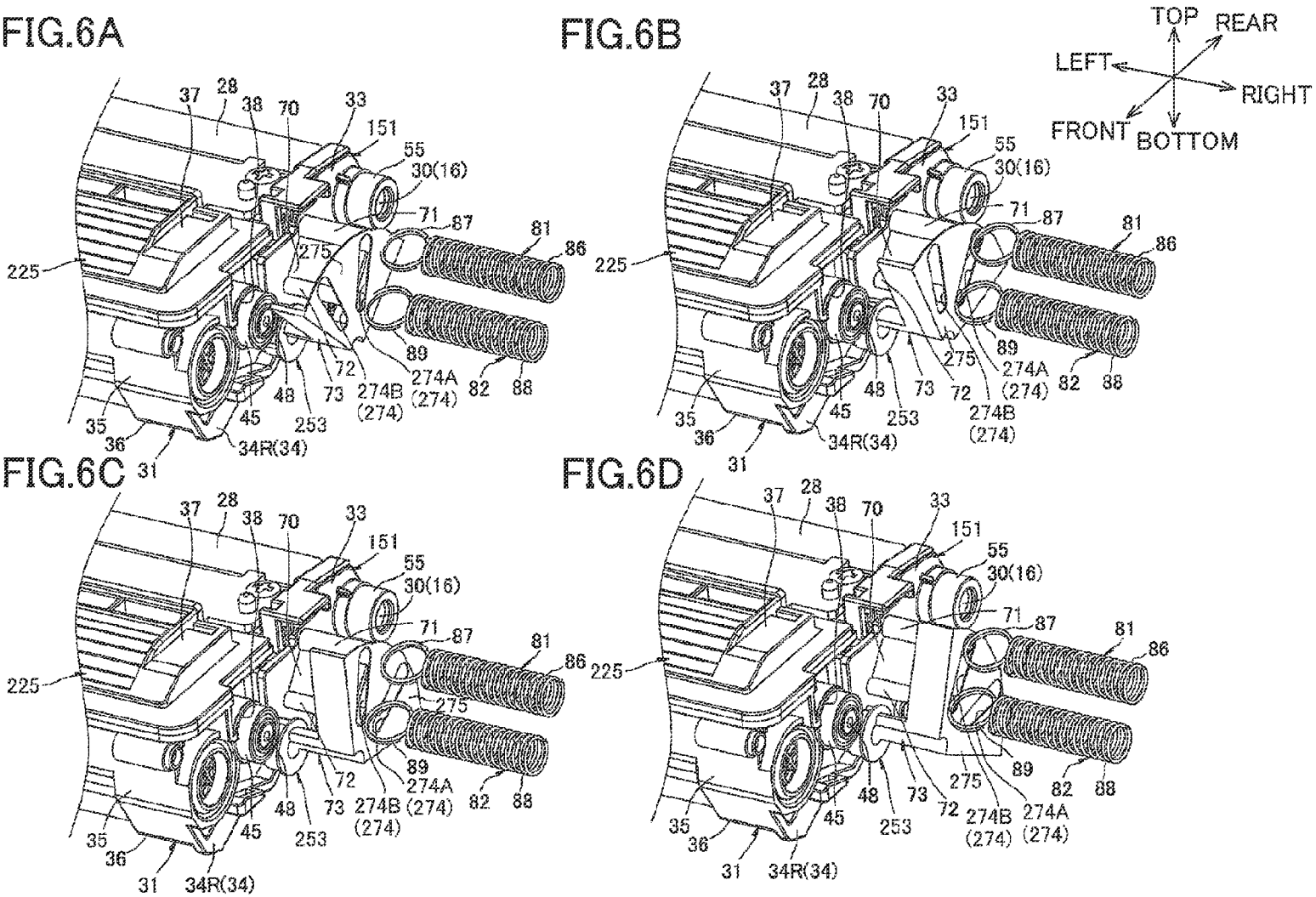

When the process cartridge 11 to which a new (unused) developing cartridge 225 is assembled is inserted into the main casing 2 from diagonally above and frontward, the power receiving portion 71 of the developing cartridge 225 confronts the contact portion 87 of the power supply electrode 81 with the insulating plate 275 interposed therebetween, and the detected portion 72 confronts the contact portion 89 of the detection electrode 82 with the insulating plate 275 interposed therebetween, as shown in FIG. 6A.

In other words, the insulating plate 275 insulates both the power receiving portion 71 from the power supply electrode 81 and the detected portion 72 from the detection electrode 82, interrupting an electrical connection between the power receiving portion 71 and the power supply electrode 81, and an electrical connection between the detected portion 72 and the detection electrode 82. That is, the moving member 253 is positioned at a first position.

Thus, the developing bias is not applied to the detection electrode 82, and, hence, the bias detection unit 83 does not detect the developing bias. Accordingly, the CPU 84 determines that the developing bias is not being supplied to the detection electrode 82.

Upon starting the warm-up operation, the moving member 253 is rotated in the clockwise direction in a right side view.

As the moving member 253 rotates, the first detection window 274A positioned at the downstream side of the insulating plate 275 in the clockwise direction in a right side view is positioned between the power receiving portion 71 and the power supply electrode 81 and between the detected portion 72 and the detection electrode 82, as shown in FIG. 6B. At this time, an electrical connection between the power receiving portion 71 and the power supply electrode 81 is established through the first detection window 274A of the insulating plate 275, and an electrical connection between the detected portion 72 and the detection electrode 82 is established through the first detection window 274A of the insulating plate 275. That is, the moving member 253 is positioned at a second position.

As a result, the developing bias supplied from the power supply electrode 81 to the power receiving portion 71 is conducted to the detection electrode 82 through the rib 70 and the detected portion 72. Accordingly, the bias detection unit 83 detects the developing bias, and the CPU 84 determines that the developing bias is being supplied to the detection electrode 82.

As a result of further rotation of the moving member 253 in the clockwise direction in a right side view, a portion of the insulating plate 275 between the two detection windows 274 (274A, 274B) is interposed between the power receiving portion 71 and the power supply electrode 81 and between the detected portion 72 and the detection electrode 82, as shown in FIG. 6C. Therefore, the insulating plate 275 insulates the power receiving portion 71 from the power supply electrode 81 and the detected portion 72 from the detection electrode 82. That is, the moving member 253 is positioned at a third position.

Thus, the developing bias is no longer applied to the detection electrode 82, and, hence, the bias detection unit 83 no longer detects the developing bias. Accordingly, the CPU 84 determines that the developing bias is not being supplied to the detection electrode 82.

The CPU 84 determines that the developing cartridge 225 is a new (unused) cartridge based on the determination that the developing bias is first not supplied to the detection electrode 82, then supplied to the detection electrode 82, and then not supplied to the detection electrode 82 in sequence after starting the warm-up operation.

In accordance with further rotation of the moving member 253 in the clockwise direction in a right side view, the toothless portion 65 of the moving member 253 is brought into confrontation with the agitator gear 45, releasing meshing engagement between the toothed portion 64 of the moving member 253 and the agitator gear 45. Thus, rotation of the moving member 253 is stopped to terminate the warm-up operation.

At the same time, the second detection window 274B positioned at the upstream side of the insulating plate 275 in the clockwise direction in a right side view is positioned between the power receiving portion 71 and the power supply electrode 81 and between the detected portion 72 and the detection electrode 82. Hence, an electrical connection between the power receiving portion 71 and the power supply electrode 81 is established through the second detection window 274B of the insulating plate 275, and an electrical connection between the detected portion 72 and the detection electrode 82 is established through the second detection window 274B of the insulating plate 275.

As a result, the developing bias supplied from the power supply electrode 81 to the power receiving portion 71 is conducted to the detection electrode 82 through the rib 70 and the detected portion 72. Accordingly, the bias detection unit 83 detects the developing bias, and the CPU 84 determines that the developing bias is being supplied to the detection electrode 82.

Then, if this state continues for a predetermined time period (if a developing bias is continually supplied to the detection electrode 82 for a predetermined time period), the CPU 84 determines that the developing cartridge 225 is assembled to the main casing 2.

(3) Operations and Effects of Third Embodiment

According to the third embodiment, operations and effects similar to the second embodiment can be obtained.

8. Fourth Embodiment

A developing cartridge 325 according to a fourth embodiment of the present invention will next be described with reference to FIGS. 7A through 7C wherein like parts and components are designated by the same reference numerals as those shown in the second embodiment (FIGS. 5A through 5D) to avoid duplicating description.

(1) Structure of Fourth Embodiment

According to the second embodiment, the moving member 153 is provided with the insulating plate 75 formed in a generally sector shape and rotatable in the clockwise direction in a right side view. In contrast, according to the fourth embodiment, a moving member 91 is generally flat rectangular plate shaped, and is slidably and linearly movable in the frontward/rearward direction.

More specifically, a power supply unit 333 includes tire moving member 91 and a pinion gear 92. The pinion gear 92 is adapted to input a driving force to the moving member 91. The power supply unit 333 further includes a gear cover (not shown) to cover a right end portion of the developing cartridge 325. The moving member 91 is supported to the gear cover.

The moving member 91 is positioned at a lower side of the power supply electrode 81 and interposed between the detected portion 72 and the detection electrode 82. The moving member 91 is generally U-shaped in a side view with its front end being open, and includes an insulating portion 95, and a rack portion 94.

The insulating portion 95 is generally rectangular plate shaped in a side view. The insulating portion 95 constitutes a rear half portion of the moving member 91. The insulating portion 95 has a generally center portion in the frontward/rearward direction formed with a detection window 96. The detection window 96 is generally rectangular shaped in a side view. The detection window 96 is penetrated through a thickness of the insulating portion 95.

The rack portion 94 is generally beam shaped extending frontward from a lower end portion of the insulating portion 95. A front half portion of the rack portion 94 is provided with a toothed portion 97 at its upper surface, and a rear half portion of the rack portion 94 is a toothless portion 98.

The pinion gear 92 is fixed to the right end portion of the agitator shaft 48. The pinion gear 92 is meshingly engageable with the front end portion of the toothed portion 97 of the rack portion 94 from above when the developing cartridge 325 is a new cartridge.

(2) Operation of Fourth Embodiment

A developing bias is not applied to the detection electrode 82 when the process cartridge 11 (developing cartridge 325) is not assembled to the main casing 2. Therefore, the bias detection unit 83 does not detect a developing bias. Then, if this state continues for a predetermined time period of a developing bias is not applied to the detection electrode 82 for a predetermined time period), the CPU 84 determines that the developing cartridge 325 is not assembled to the main casing 2.

Similar to the first embodiment, upon assembly of the new (unused) developing cartridge 325 into the main casing 2, a warm-up operation is started, so that the agitator 47 starts rotating in the clockwise direction in a right side view.

Figure 7A:
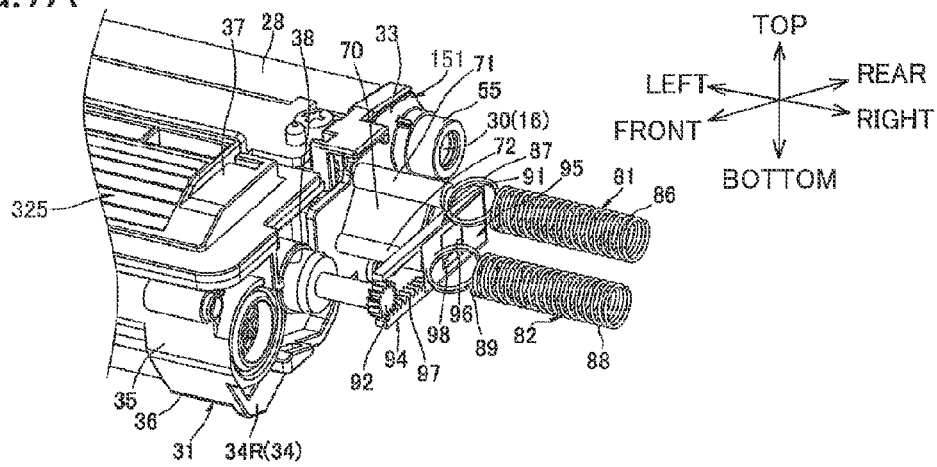

Incidentally, as shown in FIG. 7A, when the new (unused) developing cartridge 325 is assembled into the main casing 2, the power receiving portion 71 and the power supply electrode 81 are brought into contact with each other, so that an electrical connection between the power receiving portion 71 and the power supply electrode 81 is established.

Further, when the developing cartridge 325 is new, a front end portion of the insulating portion 95 (a portion forward of the detection window 96) is interposed between the detected portion 72 and the detection electrode 82. Hence, the insulating portion 95 insulates the detected portion 72 from the detection electrode 82, interrupting an electrical connection between the detected portion 72 and the detection electrode 82. That is, the moving member 91 is positioned at a first position.

Thus, the developing bias is not applied to the detection electrode 82 and, hence, the bias detection unit 83 does not detect the developing bias. Accordingly, the CPU 84 determines that the developing bias is not being supplied to the detection electrode 82.

As a result of rotation of the agitator 47, a driving force from the agitation shaft 48 is transmitted to the rack portion 94 of the moving member 91 through the pinion gear 92, so that the moving member 91 is linearly slidingly moved frontward.

Figure 7B:
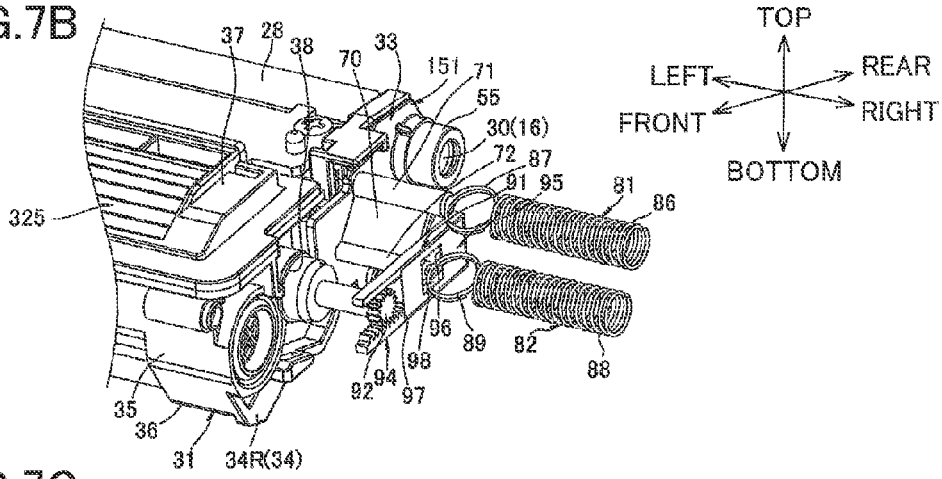

As a result, as shown in FIG. 7B, the detected portion 72 and the detection electrode 82 come into contact with each other through the detection window 96, so that an electrical connection between the detected portion 72 and the detection electrode 82 is established. That is, the moving member 91 is at a second position.

Thus, the developing bias is applied to the detection electrode 82, and, hence, the bias detection unit 83 detects the developing bias. Accordingly, the CPU 84 determines that the developing bias is being supplied to the detection electrode 82.

Figure 7C:
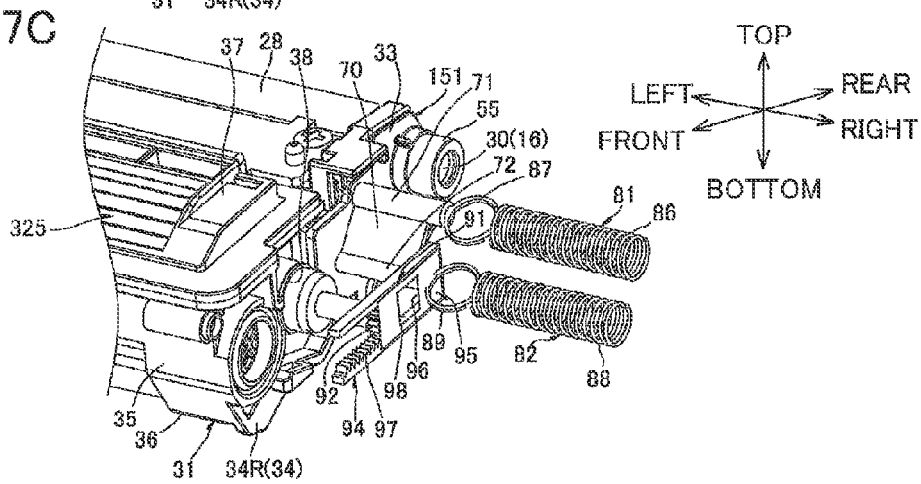

As a result of further sliding movement of the moving member 91 frontward, the toothless portion 98 of the rack portion 94 of the moving member 91 is brought into confrontation with the pinion gear 92, releasing meshing engagement between the toothed portion 97 of the rack portion 94 and the pinion gear 92, as shown in FIG. 7C. Thus, sliding movement of the moving member 91 is stopped.

At this time, a rear end portion of the insulating portion 95 (a portion rearward of the detection window 96) is interposed between the detected portion 72 and the detection electrode 82. Hence, the insulating portion 95 insulates the detected portion 72 from the detection electrode 82, interrupting an electrical connection between the detected portion 72 and the detection electrode 82. That is, the moving member 91 is positioned at a third position.

Thus, the developing bias is no longer applied to the detection electrode 82 and, hence, the bias detection unit 83 no longer detects the developing bias. Accordingly, the CPU 84 determines that the developing bias is not being supplied to the detection electrode 82.

The CPU 84 determines that the developing cartridge 325 is a new (unused) cartridge based on the determination that the developing bias is first not supplied to the detection electrode 82, then supplied to the detection electrode 82, and then not supplied to the detection electrode 82 in sequence after starting the warm-up operation.

At this point, the warm-up operation is terminated.

(3) Operations and Effects of Fourth Embodiment

According to the fourth embodiment, as shown in FIGS. 7A through 7C, the moving member 91 is linearly slidingly movable frontward.

Simple linear sliding movement of the moving member 91 can permit the moving member 91 to be moved from the first position to the second position and then from the second position to the third position. In other words, movement of the moving member 91 can be realized with a simple construction.

Further, according to the fourth embodiment, operations and effects similar to the second embodiment can be obtained.

9. Fifth Embodiment

A developing cartridge 425 according to a fifth embodiment of the present invention will next be described with reference to FIGS. 8A through 8C wherein like parts and components are designated by the same reference numerals as those shown in the first embodiment (FIGS. 1 through 4C) to avoid duplicating description.

(1) Structure of Fifth Embodiment

According to the first embodiment, the moving member 53 is formed of an electrically conductive material and is rotatable in the clockwise direction in a right side view. In contrast, according to the fifth embodiment, an electrically conductive moving member 101 is generally flat rectangular plate shaped, and slidably and linearly movable in the frontward/rearward direction.

More specifically, a power supply unit 433 includes the moving member 101 and a pinion gear 102. The pinion gear 102 is adapted to input a driving force to the moving member 101. The power supply unit 433 further includes a gear cover (not shown) to cover a right end portion of the developing cartridge 425. The moving member 101 is supported to the gear cover.

The moving member 101 is positioned at a lower side of the power supply electrode 81 and positioned between the right side surface of the cartridge electrode 51 and the detection electrode 82. The moving member 101 is generally U-shaped in a side view with its front end being open, and includes a conducting portion 104, and a rack portion 103.

The conducting portion 104 is generally rectangular plate shaped in a side view. The conducting portion 104 constitutes a rear half portion of the moving member 101. The conducting portion 104 has a generally center portion in the frontward/rearward direction formed with an opening 105. The opening 105 is generally rectangular shaped in a side view. The opening 105 is penetrated through a thickness of the conducting portion 104. Further, the conducting portion 104 has an upper end portion provided with a projection 108. The projection 108 protrudes upward from an upper edge of the conducting portion 104. The projection 108 is generally trapezoidal in a side view, with an upper base shorter than a lower base.

The rack portion 103 is generally beam shaped extending frontward from a lower end portion of the conducting portion 104. A front half portion of the rack portion 103 is provided with a toothed portion 106 at its upper surface, and a rear half portion of the rack portion 103 is the toothless portion 107.

The pinion gear 102 is fixed to the right end portion of the agitator shaft 48. The pinion gear 102 is meshingly engageable with the front end portion of the toothed portion 106 of the rack portion 103 from above when the developing cartridge 425 is a new cartridge.

(2) Operation of Fifth Embodiment

A developing bias is not applied to the detection electrode 82 when the process cartridge 11 (developing cartridge 425) is not assembled to the main casing 2. Therefore, the bias detection unit 83 does not detect a developing bias. Then, if this state continues for a predetermined time period (if a developing bias is not applied to the detection electrode 82 for a predetermined time period), the CPU 84 determines that the developing cartridge 425 is not assembled to the main casing 2.

Similar to the first embodiment, upon assembly of the new (unused) developing cartridge 425 into the main casing 2, a warm-up operation is started, so that the agitator 47 starts rotating in the clockwise direction in a right side view.

Figure 8A:
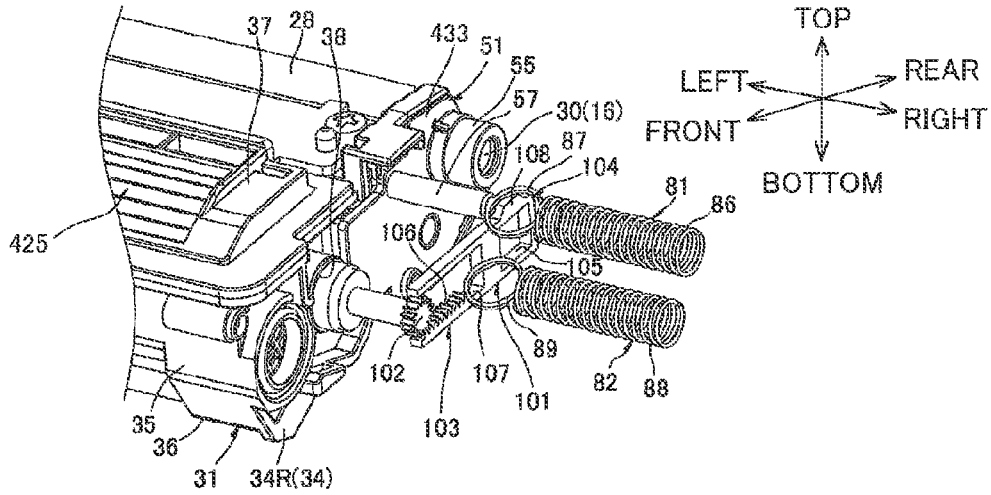

Incidentally, as shown in FIG. 8A, when the new (unused) developing cartridge 425 is assembled into the main casing 2, the power receiving portion 57 and the power supply electrode 81 are brought into contact with each other, so that an electrical connection between the power receiving portion 57 and the power supply electrode 81 is established.

Further, when the developing cartridge 425 is new, the contact portion 89 of the detection electrode 82 is positioned in confrontation with but slightly spaced away from the conducting portion 104 at a front side thereof, so as not to contact the conducting portion 104. Further, the projection 108 of the conducting portion 104 is positioned in confrontation with but slightly spaced away from the power receiving portion 57 at a diagonally lower rear side thereof, so as not to contact the power receiving portion 57.

Thus, the developing bias is not applied to the detection electrode 82 and, hence, the bias detection unit 83 does not detect the developing bias. That is, the moving member 101 is positioned at a first position. Accordingly, the CPU 84 determines that the developing bias is not being supplied to the detection electrode 82.

As a result of rotation of the agitator 47, a driving force from the agitation shaft 48 is transmitted to the rack portion 103 of the moving member 101 through the pinion gear 102, so that the moving member 101 is linearly slidingly moved frontward.

Figure 8B:
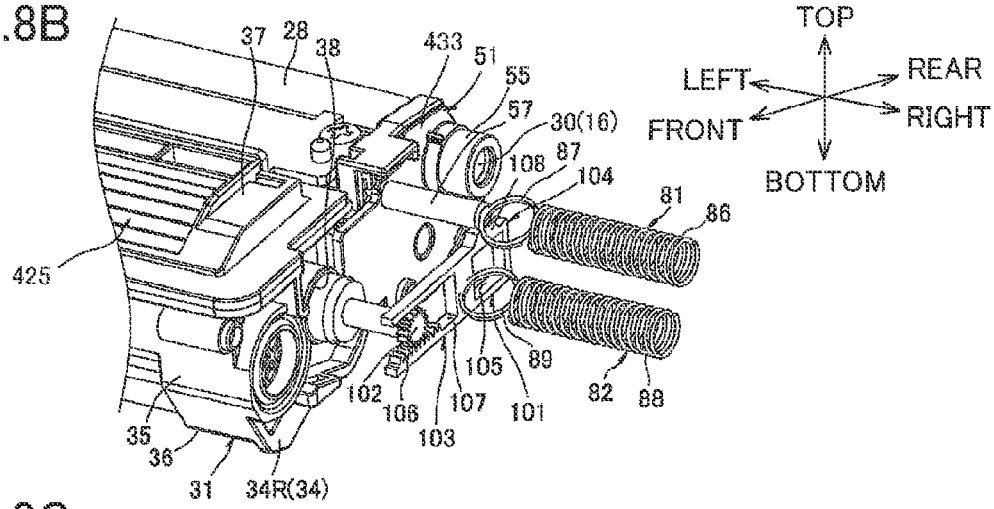

As a result, as shown in FIG. 8B, a front end portion of the conducting portion 104 (a portion forward of the opening 105) is brought into contact with the detection electrode 82, while the projection 108 of the conducting portion 104 is brought into contact with a lower edge of the power receiving portion 57 from a lower side thereof. In this state, an electrical connection is established between the detection electrode 82 and the power receiving portion 57 through the conducting portion 104.

Thus, the developing bias is applied to the detection electrode 82 through the conducting portion 104, and, hence, the bias detection unit 83 detects the developing bias. That is, the moving member 101 is positioned at a second position. Accordingly, the CPU 84 determines that the developing bias is being supplied to the detection electrode 82.

Figure 8C:
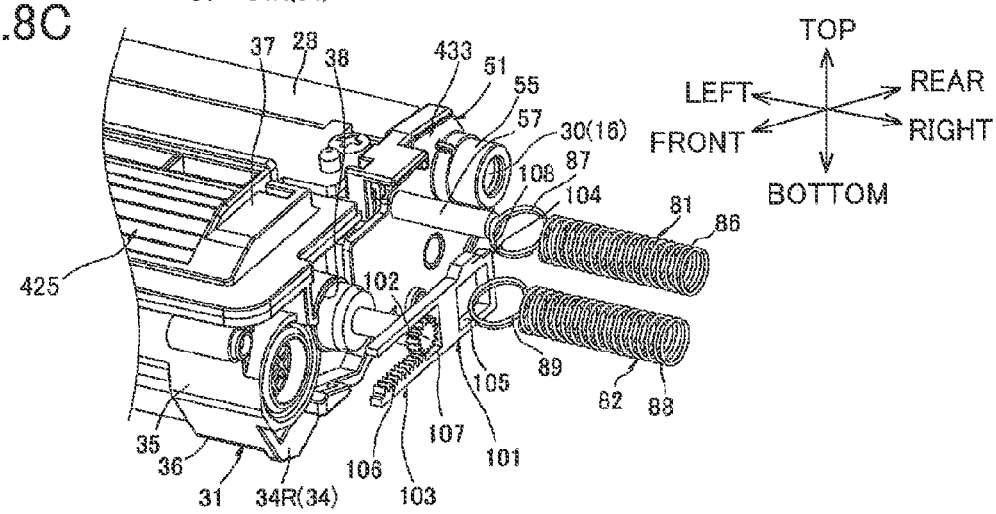

As a result of further sliding movement of the moving member 101 frontward, the toothless portion 107 of the rack portion 103 of the moving member 101 is brought into confrontation with the pinion gear 102, releasing meshing engagement between the toothed portion 106 of the rack portion 103 and the pinion gear 102, as shown in FIG. 8C. Thus, sliding movement of the moving member 101 is stopped.

At this time, the contact portion 89 of the detection electrode 82 is positioned in confrontation with the opening 105 of the conducting portion 104 so as not to contact the conducting portion 104. Further, the projection 108 of the conducting portion 104 is positioned in confrontation with but spaced away from the power receiving portion 57 at a diagonally lower front side thereof.

Thus, the developing bias is no longer applied to the detection electrode 82 and, hence, the bias detection unit 83 no longer detects the developing bias. That is, the moving member 101 is positioned at a third position. Accordingly, the CPU 84 determines that the developing bias is not being supplied to the detection electrode 82.

The CPU 84 determines that the developing cartridge 425 is a new (unused) cartridge based on the determination that the developing bias is first not supplied to the detection electrode 82, then supplied to the detection electrode 82, and then not supplied to the detection electrode 82 in sequence after starting the warm-up operation.

At this point, the warm-up operation is terminated.

(3) Operations and Effects of Fifth Embodiment

According to the fifth embodiment, as shown in FIGS. 8A through 8C, the moving member 101 is linearly slidingly movable frontward.

Simple linear sliding movement of the moving member 101 can permit the moving member 101 to be moved from the first position to the second position and then from the second position to the third position. In other words, movement of the moving member 101 can be realized with a simple construction.

Further, according to the fifth embodiment, operations and effects similar to the second embodiment can be obtained.

10. Sixth Embodiment

A developing cartridge 525 according to a sixth embodiment of the present invention will next be described with reference to FIGS. 9A through 10B wherein like parts and components are designated by the same reference numerals as those shown in the first embodiment (FIGS. 1 through 4C) to avoid duplicating description.

(1) Structure of Sixth Embodiment

According to the first embodiment, the moving member 53 is formed of an electrically conductive material. Further, the moving member 53 is rotatably supported to the electrode support boss 56 of the cartridge electrode 51 and rotatable in the clockwise direction in a right side view.

Figure 9B:
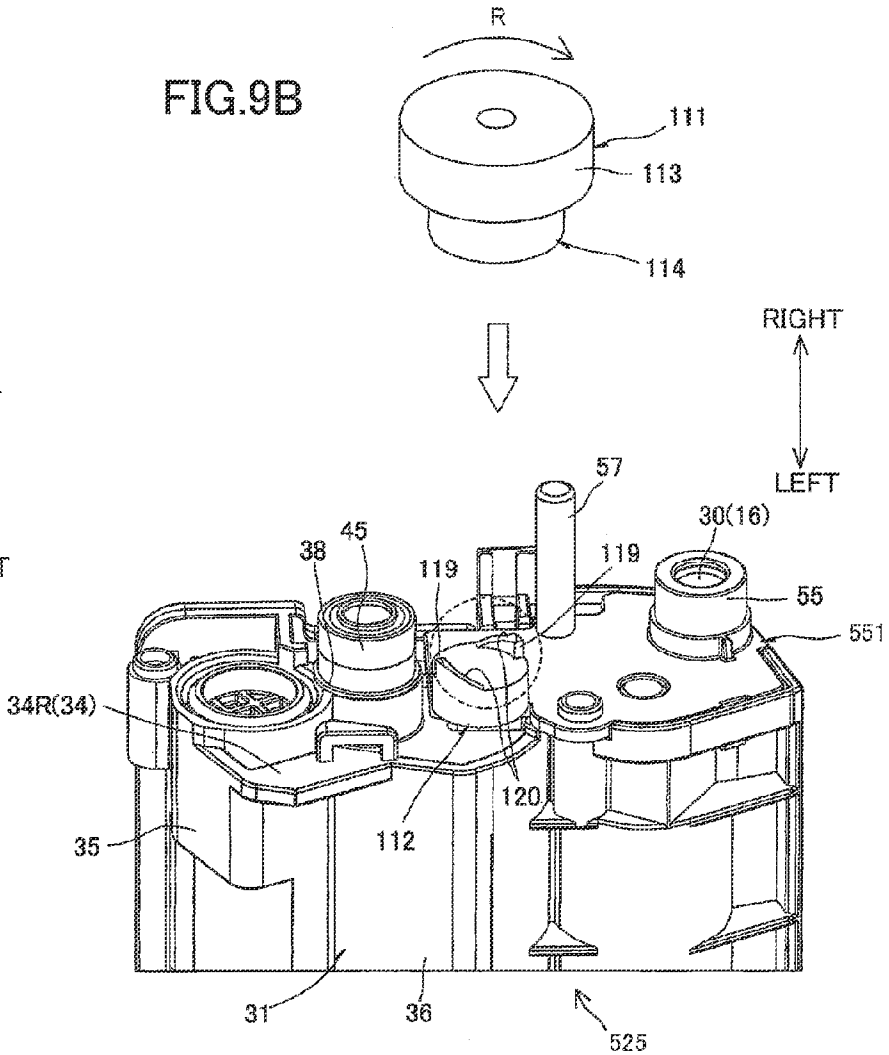
FIG. 9B is a perspective view for description of assembly of the moving member to a cartridge electrode.

In contrast, according to the sixth embodiment, a moving member 111 is rotatably supported to a support boss 112 of a bearing member 551, and is rotatable in the clockwise direction in a right side view and is movable in the lateral direction relative to the support boss 112, as shown in FIG. 9B.

Figure 9A:
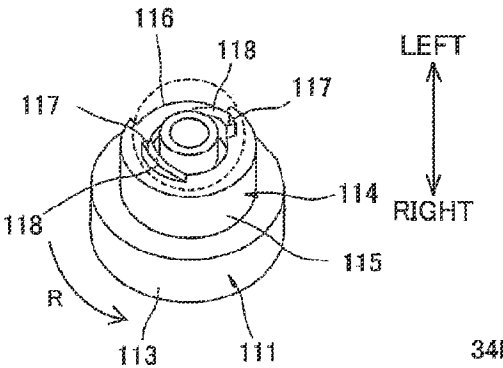
FIG. 9A is a perspective view of a moving member according to a sixth embodiment of the present invention as viewed from a left side.

More specifically, the moving member 111 is formed of an electrically conductive material. Further, as shown in FIG. 9A, the moving member 111 integrally includes an electrode body 113 and a chipped gear 114.

The electrode body 113 is generally cylindrical extending in the lateral direction, and has a flat right side surface.

The chipped gear 114 is generally cylindrical and extends leftward from a left side surface of the electrode body 113 coaxially with the electrode body 113. The chipped gear 114 has an outer peripheral surface provided with a toothed portion 115 whose center angle is approximately 270 degrees. A toothless portion 116 is defined at the outer peripheral surface and other than the toothed portion 115. The chipped gear 114 has two displacement portions 117 (FIG. 9A).

Each displacement portion 117 protrudes leftward from a left side surface of the chipped gear 114, and extends in an arcuate fashion whose center of radius of curvature is at an axial center of the chipped gear 114. The two displacement portions 117 are spaced away from each other at diametrically opposite sides. Each displacement portion 117 has a left side surface 118 which is inclined leftward toward an upstream side in a rotational direction R of the moving member 111.

The rotational direction R is the clockwise direction in a right side view, as described later.

The support boss 112 is positioned at a front end portion of the bearing member 551, and protrudes rightward from a right side surface thereof. The support boss 112 is generally cylindrical shaped and has two displacement portions 119.

Each displacement portion 119 protrudes rightward from a right side surface of the support boss 112, and extends in an arcuate fashion whose center of radius of curvature is at an axial center of the support boss 112. The two displacement portions 119 are spaced away from each other at diametrically opposite sides. Each displacement portion 119 has a right side surface 120 which is inclined rightward toward a downstream side in the rotational direction R of the moving member 111.

The moving member 111 is coaxial with the support boss 112, and is rotatably supported to a right end portion of the support boss 112 such that each upstream end portion of each displacement portion 117 of the moving member 111 in the rotational direction R is in abutment with each upstream end portion of each displacement portion 119 of the support boss 112 in the rotational direction R.

Figure 10A:
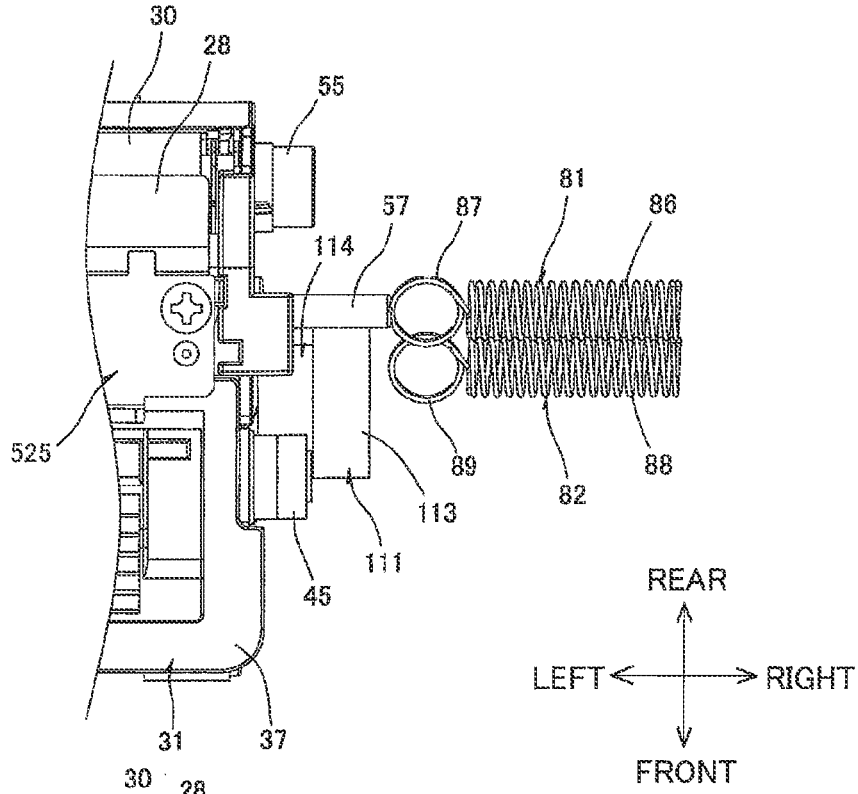
Figure 10B:
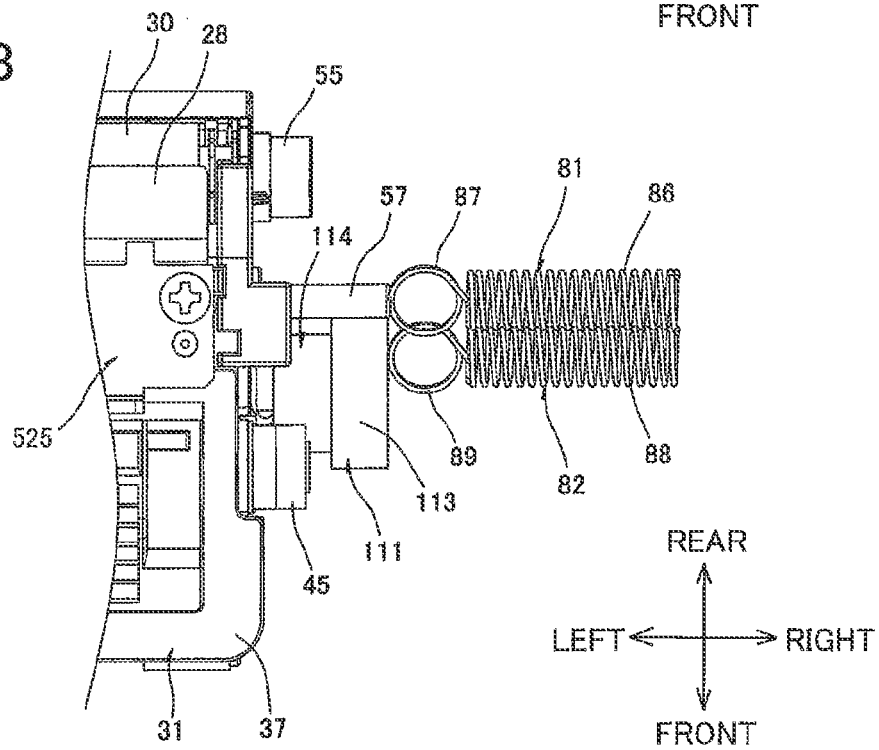

The moving member 111 is rotatable in the rotational direction R such that the displacement portions 117 slide with respect to the displacement portions 119. By the rotation, the moving member 111 is movable between an advanced position as shown in FIG. 10B advanced rightward and a retracted position as shown in FIG. 10A retracted leftward.

Incidentally, the moving member 111 is normally urged leftward by an urging member (not shown) such as a spring.

(2) Operation of Sixth Embodiment

A developing bias is not applied to the detection electrode 82 when the process cartridge 11 (developing cartridge 525) is not assembled to the main casing 2. Therefore, the bias detection unit 83 does not detect a developing bias. Then, if this state continues for a predetermined time period (if a developing bias is not applied to the detection electrode 82 for a predetermined time period), the CPU 84 determines that the developing cartridge 525 is not assembled to the main casing 2.

Similar to the first embodiment, upon assembly of the new (unused) developing cartridge 525 into main casing 2, a warm-up operation is started, so that the agitator 47 starts rotating.

Incidentally, as shown in FIG. 10A, when the new (unused) new developing cartridge 525 is assembled into the main casing 2, the power receiving portion 57 and the power supply electrode 81 are brought into contact with each other, so that an electrical connection between the power receiving portion 57 and the power supply electrode 81 is established.

Further, when the new developing cartridge 525 is new, the moving member 111 is positioned in confrontation with and spaced away from the contact portion 89 of the detection electrode 82 at a left side thereof.

Thus, the developing bias is not applied to the detection electrode 82, and, hence, the bias detection unit 83 does not detect the developing bias. That is, the moving member 111 is positioned at a first position. Accordingly, the CPU 84 determines that the developing bias is not being supplied to the detection electrode 82.

As a result of rotation of the agitator 47, a driving force from the agitation shaft 48 is transmitted to the toothed portion 115 of the chipped gear 114 of the moving member 111 through the agitator gear 45, so that the moving member 111 is rotated in the clockwise direction in a right side view.

As the moving member 111 rotates, relative sliding movement occurs between the left side surface 118 of each displacement portion 117 of the moving member 111 and the right side surface 120 of each displacement portion 119 of the support boss 112. Thus, the moving member 111 is gradually moved rightward in accordance with rotation of the moving member 111.

As a result, as shown in FIG. 10B, the electrode body 113 of the moving member 111 is brought into contact with the detection electrode 82 from a left side thereof. In this state, an electrical connection between the moving member 111 and the detection electrode 82 is established.

Thus, the developing bias supplied to the cartridge electrode 551 by the power receiving portion 57 is applied to the detection electrode 82 sequentially through the support boss 112 of the cartridge electrode 551 and the moving member 111. As a result, the bias detection unit 83 detects the developing bias. That is, the moving member 111 is positioned at a second position. Accordingly, the CPU 84 determines that the developing bias is being supplied to the detection electrode 82.

As a result of further rotation of the moving member 111 in the clockwise direction in a right side view, each displacement portion 117 of the moving member 111 is positioned downstream of the corresponding displacement portion 119 of the support boss 112 in the rotational direction R. Consequently, the moving member 111 can be moved leftward.

Thus, moving member 111 is pushed leftward by the urging force of the urging member (not shown), so that the moving member 111 is moved leftward so as to be retracted from the detection electrode 82. Consequently, the moving member 111 is spaced away from the detection electrode 82.

As a result, the developing bias is no longer applied to the detection electrode 82 and, hence, the bias detection unit 83 no longer detects the developing bias. That is, the moving member 111 is positioned at a third position. Accordingly, the CPU 84 determines that the developing bias is not being supplied to the detection electrode 82.

In accordance with further rotation of the moving member 111 in the clockwise direction in a right side view, the toothless portion 116 of the moving member 111 is brought into confrontation with the agitator gear 45, releasing meshing engagement between the toothed portion 115 of the moving member 111 and the agitator gear 45. Thus, rotation of the moving member 111 is stopped to terminate the warm-up operation.

The CPU 84 determines that the developing cartridge 525 is a new (unused) cartridge based on the determination that the developing bias is first not supplied to the detection electrode 82, then supplied to the detection electrode 82, and then not supplied to the detection electrode 82 in sequence after starting the warm-up operation.

(3) Operations and Effects of Sixth Embodiment

According to the sixth embodiment, as shown in FIG. 10A, with a simple structure, the moving member 111 can be retracted leftward from the detection electrode 82, thereby reliably interrupting the electrical connection between the moving member 111 and the detection electrode 82 when the moving member 111 is at both the first position and the third position.

Further, according to the sixth embodiment, operations and effects similar to the first embodiment can be obtained.

11. Seventh Embodiment

A developing cartridge 625 according to a seventh embodiment of the present invention will next be described with reference to FIGS. 11A and 11B wherein like parts and components are designated by the same reference numerals as those shown in the sixth embodiment (FIGS. 9A through 10B) to avoid duplicating description.

(1) Structure of Seventh Embodiment

According to the sixth embodiment, the moving member 111 is formed of an electrically conductive material. However, a moving member 611 can be formed of an insulating material instead.

Figure 11A:
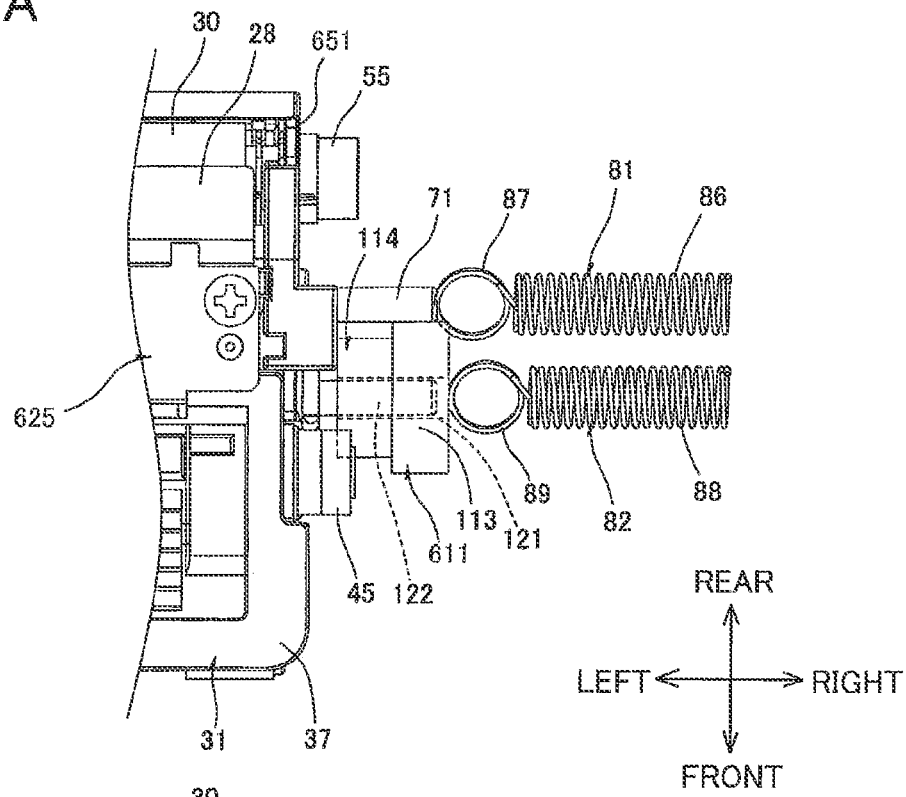
Figure 11B:
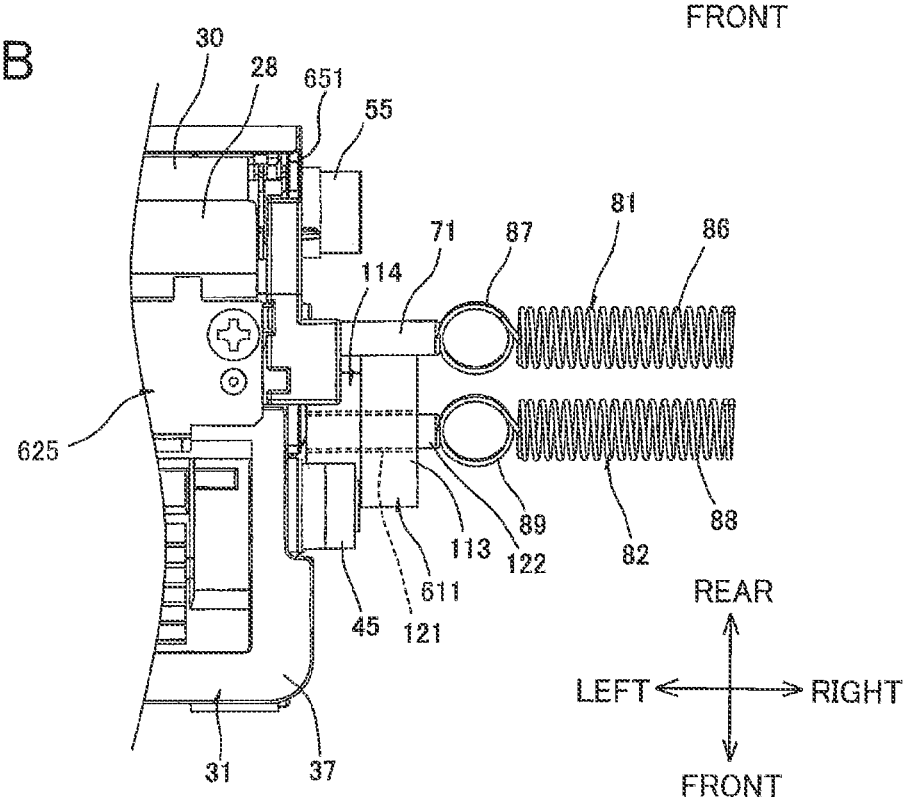

In this case, as shown in FIGS. 11A and 11B, the moving member 111 is formed with an insertion hole 121 at a diametrical center thereof. The insertion hole 121 is coaxial with the moving member 611 and penetrated through the moving member 611.

Further, the support boss 612 (not shown but similar to FIG. 9B) has a detected portion 122. The detected portion 122 is generally cylindrical shaped, protruding rightward from the right side surface of the support boss 112. The detected portion 122 is coaxial with the support boss 112. The detected portion 122 has an outer diameter approximately equal to or smaller than an inner diameter of the insertion hole 121. The detected portion 122 has a length in the lateral direction greater than that of the moving member 611.

Further, the moving member 611 is rotatably supported to the support boss 112 such that the detected portion 122 extends through the insertion hole 121 and is rotatable relative to the insertion hole 121 and that each upstream end portion of each displacement portion 117 (FIG. 9A) of the moving member 611 in the rotational direction R is in abutment with each downstream end portion of each displacement portion 119 (FIG. 9B) of the support boss 112 in the rotational direction R.

At this time, the right side surface of the moving member 611 is positioned farther right than a right end portion of the detected portion 122. Further, the toothed portion 115 of the moving member 611 is in meshing engagement with the right end portion of the agitator gear 45 at a left end portion of the toothed portion 115 (FIG. 11A).

(2) Operations of Seventh Embodiment

A developing bias is not applied to the detection electrode 82 when the process cartridge 11 (developing cartridge 625) is not assembled to the main casing 2. Therefore, the bias detection unit 83 does not detect a developing bias. Then, if this state continues for a predetermined time period (if a developing bias is not applied to the detection electrode 82 for a predetermined time period), the CPU 84 determines that the developing cartridge 625 is not assembled to the main casing 2.

Upon assembly of the developing cartridge 625 into the main casing 2, as shown in FIG. 11A, the moving member 611 is brought into contact with the detection electrode 82.

At this time, the moving member 611 is interposed between the detected portion 122 and the detection electrode 82, insulating the cartridge electrode 651 from the detection electrode 82. That is, the moving member 611 is positioned at a first position.

Thus, the developing bias is not applied to the detection electrode 82, and, hence, the bias detection unit 83 does not detect the developing bias. Accordingly, the CPU 84 determines that the developing bias is not being supplied to the detection electrode 82.

Upon starting the warm-up operation, the moving member 611 rotated in the clockwise direction in a right side view.

Then, each displacement portion 117 of the moving member 611 is positioned downstream of the corresponding displacement portion 119 of the support boss 612 in the rotational direction R. Consequently, the moving member 611 is retracted leftward by the urging force of the urging member (not shown) such that the moving member 611 is spaced away from the detection electrode 82 (FIG. 11B). At this time, each of the displacement portions 117 which has been abutted on one of the displacement portions 119 is positioned in confrontation with a remaining one of the displacement portions 119 at an upstream side thereof in the rotational direction R.

As a result, the right end portion of the detected portion 122 relatively protrudes rightward through the insertion hole 121 of the moving member 611, so that the right end portion of the detected portion 122 contacts the detection electrode 82. That is, the moving member 611 is positioned at a second position.

Thus, the developing bias is applied to the detection electrode 82, and hence, the bias detection unit 83 detects the developing bias. Accordingly, the CPU 84 determines that the developing bias is being supplied to the detection electrode 82.

As a result of further rotation of the moving member 611 in the clockwise direction in a right side view, relative sliding movement occurs between the left side surface 118 of each displacement portion 117 of the moving member 611 and the right side surface 120 of each displacement portion 119 of the support boss 112. Thus, the moving member 611 is gradually moved rightward in accordance with rotation of the moving member 611.

As a result, as shown in FIG. 11A, the moving member 611 is advanced rightward such that the right side surface of the moving member 611 is positioned farther right than the right end portion of the detected portion 122.

Then, the moving member 611 is once again interposed between the detected portion 122 and the detection electrode 82, insulating the cartridge electrode 651 from the detection electrode 82. That is, the moving member 611 is positioned at a third position.

As a result, the developing bias is no longer applied to the detection electrode 82 and, hence, the bias detection unit 83 no longer detects the developing bias. Accordingly, the CPU 84 determines that the developing bias is not being supplied to the detection electrode 82.

In accordance with further rotation of the moving member 611 in the clockwise direction in a right side view, the toothless portion 116 of the moving member 611 is brought into confrontation with the agitator gear 45, releasing meshing engagement between the toothed portion 115 of the moving member 611 and the agitator gear 45. Thus, rotation of the moving member 611 is stopped to terminate the warm-up operation.

The CPU 84 determines that the developing cartridge 625 is a new (unused) cartridge based on the determination that the developing bias is first not supplied to the detection electrode 82, then supplied to the detection electrode 82, and then not supplied to the detection electrode 82 in sequence after starting the warm-up operation.

(3) Operations and Effects of Seventh Embodiment

According to the seventh embodiment, as shown in FIG. 11A, with a simple structure, the moving member 611 can be advanced rightward toward the detection electrode 82, thereby reliably interrupting the electrical connection between the cartridge electrode 651 and the detection electrode 82 when the moving member 611 is at both the first position and the third position.

Further, according to the seventh embodiment, operations and effects similar to the sixth embodiment can be obtained.

While the present invention has been described in detail with reference to the embodiments thereof, it would be apparent to those skilled in the art that various changes and modifications may be made therein without departing from the spirit of the present invention.

What is claimed is:

1. An image forming apparatus comprising:

a main casing;

a cartridge configured to be attached to and detached from the main casing and to accommodate therein developing agent, the cartridge having a cartridge electrode configured to receive electric power from the main casing; and a processing unit provided in the main casing and configured to determine a condition of the cartridge, the main casing comprising:

a first main electrode configured to be electrically connected to the cartridge electrode and configured to supply electric power to the cartridge electrode; and a second main electrode configured to be electrically connected to the cartridge electrode and configured to receive electric power from the cartridge electrode, the cartridge comprising:

a moving member configured to be moved from a first position where an electrical connection is interrupted between the cartridge electrode and at least one of the first main electrode and the second main electrode to a second position where an electrical connection is established between the cartridge electrode and the first main electrode and between the cartridge electrode and the second main electrode, and then, from the second position to a third position where an electrical connection is interrupted between the cartridge electrode and at least one of the first main electrode and the second main electrode, the third position being different from the first position, wherein the processing unit determines that the condition of the cartridge is new when, in sequence after the cartridge has been attached to the main casing, the electrical connection is established between the cartridge electrode and the first main electrode and between the cartridge electrode and the second main electrode after the electrical connection is interrupted between the cartridge electrode and at least one of the first main electrode and the second main electrode, and then the electrical connection is once again interrupted between the cartridge electrode and at least one of the first main electrode and the second main electrode.

2. The image forming apparatus as claimed in claim 1, wherein the cartridge electrode comprising a first contact portion configured to be contacted with the first main electrode, and a second contact portion configured to be contacted with the second main electrode;

wherein the moving member comprising an insulating portion formed of an insulating material; and wherein the insulating portion is provided at at least one of a position between the first contact portion and the first main electrode and a position between the second contact portion and the second main electrode when the moving member is at the first position and at the third position, the insulating portion being displaced from the position between the first contact portion and the first main electrode and the position between the second contact portion and the second main electrode when the moving member is at the second position.

3. The image forming apparatus as claimed in claim 2, wherein the moving member is provided with a partially toothed gear comprising a toothed portion to which a driving force from the main casing is transmittable, and a toothless portion prohibiting transmission of the driving force.

4. The image forming apparatus as claimed in claim 3, wherein the moving member is configured to be rotated in a rotating direction so as to be moved from the first position to the second position and then from the second position to the third position.

5. The image forming apparatus as claimed in claim 3, wherein the moving member is configured to be linearly moved so as to be moved from the first position to the second position and then from the second position to the third position.

6. The image forming apparatus as claimed in claim 3, wherein the moving member is configured to be advanced toward one of the first main electrode and the second main electrode when the moving member is at the first position and at the third position and to be retracted from one of the first main electrode and the second main electrode when the moving member is at the second position.

7. The image forming apparatus as claimed in claim 1, wherein the cartridge electrode comprising a first contact portion configured to be contacted with the first main electrode, and a second contact portion configured to be contacted with the second main electrode;

wherein the moving member comprising a conducting portion formed of an electrically conductive material; and wherein the conducting portion is displaced from at least one of a position between the first contact portion and the first main electrode and a position between the second contact portion and the second main electrode when the moving member is at the first position and at the third position, the conducting portion being provided at the position between the first contact portion and the first main electrode and the position between the second contact portion and the second main electrode when the moving member is at the second position.

8. The image forming apparatus as claimed in claim 7, wherein the moving member is provided with a partially toothed gear comprising a toothed portion to which a driving force from the main casing is transmittable, and a toothless portion prohibiting transmission of the driving force.

9. The image forming apparatus as claimed in claim 8, wherein the moving member is configured to be rotated in a rotating direction so as to be moved from the first position to the second position and then from the second position to the third position.

10. The image forming apparatus as claimed in claim 8, wherein the moving member is configured to be linearly moved so as to be moved from the first position to the second position and then from the second position to the third position.

11. The image forming apparatus as claimed in claim 8, wherein the moving member is configured to be retracted from one of the first main electrode and the second main electrode when the moving member is at the first position and at the third position and to be advanced toward one of the first main electrode and the second main electrode when the moving member is at the second position.

12. The image forming apparatus as claimed in claim 1, further comprising a developing roller configured to carry developing agent thereon, wherein the cartridge electrode is configured to be electrically connected to the developing roller.

13. The image forming apparatus as claimed in claim 1, wherein the processing unit determines that the cartridge has been attached to the main casing when the electrical connection has been provided between the cartridge electrode and the first main electrode and between the cartridge electrode and the second main electrode for not less than a predetermined period of time, and that the cartridge has been detached from the main casing when the electrical connection has been interrupted between the cartridge electrode and at least one of the first main electrode and the second main electrode for not less than a predetermined period of time.

14. The image forming apparatus as claimed in claim 1, wherein the processing unit determines that the condition of the cartridge is not new when no electrical connection is established between the cartridge electrode and at least one of the first main electrode and the second main electrode after the cartridge has been attached to the main casing because the moving member remains in the third position.

* * * * *